US007147033B2

(12) United States Patent
Yamamoto et al.

(10) Patent No.: US 7,147,033 B2
(45) Date of Patent: Dec. 12, 2006

(54) DUAL DRUM TYPE CONTINUOUS CASTING DEVICE AND METHOD FOR CONTINUOUS CASTING

(75) Inventors: Keiichi Yamamoto, Hiroshima (JP); Ritsuo Hashimoto, Hiroshima (JP); Mitsuo Tani, Hiroshima (JP); Kazutoshi Yokoo, Hiroshima (JP); Jyoji Yusa, Hiroshima (JP); Kunimasa Sasaki, Tokyo (JP); Katsuyoshi Miyake, Hiroshima (JP); Katsuyuki Isogami, Hikari (JP); Mamoru Yamada, Hikari (JP); Tsuyoshi Tanaka, Hikarai (JP); Takashi Arai, Hikari (JP); Tadahiro Izu, Hikari (JP); Keiji Tsunenari, Futtsu (JP); Kazuto Yamamura, Futtsu (JP); Hiroshi Izaki, Hikari (JP)

(73) Assignees: Mitsubishi Heavy Industries, Ltd., Tokyo (JP); Nippon Steel Corporation, Tokyo (JP)

( * ) Notice: Subject to any disclaimer, the term of this patent is extended or adjusted under 35 U.S.C. 154(b) by 709 days.

(21) Appl. No.: 10/069,069

(22) PCT Filed: Jul. 19, 2001

(86) PCT No.: PCT/JP01/06268

§ 371 (c)(1),
(2), (4) Date: May 21, 2002

(87) PCT Pub. No.: WO02/05987

PCT Pub. Date: Jan. 24, 2002

(65) Prior Publication Data

US 2002/0170701 A1 Nov. 21, 2002

(30) Foreign Application Priority Data

Jul. 19, 2000 (JP) ..... 2000-218659
Jul. 27, 2000 (JP) ..... 2000-226615
Jan. 24, 2001 (JP) ..... 2001-015357
Jul. 4, 2001 (JP) ..... 2001-203798

(51) Int. Cl.
*B22D 11/06* (2006.01)

(52) U.S. Cl. ..... 164/443; 164/428; 164/485

(58) Field of Classification Search ..... 164/480, 164/448, 428, 443
See application file for complete search history.

(56) References Cited

U.S. PATENT DOCUMENTS 4,071,081 A * 1/1978 Chielens et al. ..... 165/82

(Continued)

FOREIGN PATENT DOCUMENTS

AU 9878422 A 2/1999

(Continued)

*Primary Examiner*—Len Tran
(74) *Attorney, Agent, or Firm*—Birch, Stewart, Kolasch & Birch, LLP

(57) ABSTRACT

A twin-drum continuous casting apparatus for casting a metal sheet (4) by supplying molten metal (3) to a pouring basin formed by a pair of cooling drums (1) rotating in opposite directions, and side gates (2), to cool the molten metal (3) by contact with surfaces of the cooling drums (1), thereby forming a solidified shell. The cooling drum (1) is formed from a drum body (11) having shaft portions at opposite end portions, and a drum sleeve (10) fitted on an outer peripheral portion of the drum body (11). Also, means is provided for preventing various adverse influences due to differences in thermal expansion of constituent members of the drum body (11) during casting. Thus, the reliability of the apparatus is increased, and the quality of casting is improved.

19 Claims, 16 Drawing Sheets

U.S. PATENT DOCUMENTS

| | | | | | |
|---|---|---|---|---|---|
| 4,442,883 | A | * | 4/1984 | Yamakami et al. | 164/448 |
| 4,565,240 | A | * | 1/1986 | Shibuya et al. | 164/480 |
| 4,993,478 | A | * | 2/1991 | George, II | 164/479 |
| 5,469,909 | A | * | 11/1995 | Sasaki et al. | 164/428 |
| 5,560,421 | A | | 10/1996 | Tanaka et al. | |
| 5,996,680 | A | | 12/1999 | Fukase et al. | |

FOREIGN PATENT DOCUMENTS

| | | | |
|---|---|---|---|
| CN | 1113841 | A | 12/1995 |
| CN | 1114924 | A | 1/1996 |
| DE | 3839110 | A | 6/1989 |
| DE | 198 34 289 | A | 2/1999 |
| EP | 0 664 173 | A | 7/1995 |
| FR | 2 766 741 | A | 2/1999 |
| GB | 2 327 630 | A | 2/1999 |
| JP | 61-189847 | A | 8/1986 |
| JP | 1-133642 | A | 5/1989 |
| JP | 5-275 | | 1/1993 |
| JP | 7-204792 | A | 8/1995 |
| JP | 8-39222 | A | 2/1996 |
| JP | 11-57952 | A | 3/1999 |
| JP | 11-239850 | A | 9/1999 |
| KR | 99014032 | A | 2/1999 |
| TW | 253853 | A | 8/1995 |

* cited by examiner (a)

(b)

DUAL DRUM TYPE CONTINUOUS CASTING DEVICE AND METHOD FOR CONTINUOUS CASTING

This application is the national phase under 35 U.S.C. § 371 of PCT International Application No. PCT/JP01/06268 which has an International filing date of Jul. 19, 2001, which designated the United States of America.

TECHNICAL FIELD

This invention relates to a twin-drum continuous casting apparatus and method for continuously casting a metal sheet.

BACKGROUND ART

FIG. 17 is a perspective view of a general drum continuous casting apparatus.

According to this apparatus, molten metal 3 is supplied to a pouring basin formed by a pair of cooling drums 1, 1, rotating in opposite directions (directions of arrows in the drawing), and side gates 2, 2, and is brought into contact with the surfaces of the cooling drums 1, 1 to form a solidified shell, casting a thin strip cast piece (metal sheet) 4.

FIG. 18 is an enlarged sectional view taken on line D—D of FIG. 17, showing a sliding portion of the side gate in sliding contact with end portions of the cooling drums at a kissing point at which the surfaces of the pair of cooling drums become closest to each other.

End surfaces 1*a*, 1*a* of the pair of cooling drums 1, 1 move in sliding contact with a ceramic plate 5 mounted on the side gate 2, and edge portions 1*b*, 1*b* of the surfaces of the pair of cooling drums 1, 1 seal up the molten metal 3, thereby preventing the molten metal 3 from leaking to the outside of the pouring basin. At this time, the end surfaces 1*a*, 1*a* of the pair of cooling drums 1, 1 have to be free from relative displacement in the axial direction (the drum axis direction) with respect to each other, and have to contact the ceramic plate 5 on planes.

The conventional internal structures of the above-described cooling drum 1 are shown in FIGS. 19 to 21.

Each of the cooling drums 1 has a structure in which an outer drum sleeve 10 of a copper (Cu) alloy is supported, from inside, by a drum body (core member) 11 of steel (SUS) in order to increase the rigidity of the cooling drum 1. Hollow shaft portions 11*a* are integrally assembled to opposite end portions of the drum body 11. Arrows in FIGS. 19 to 21 indicate the flow of cooling water.

The cooling drum shown in FIG. 19 was proposed by the present applicant in Japanese Patent Application No. 1986-66897. It is composed of the drum body 11, the drum sleeve 10 detachably fitted on an outer peripheral portion of the drum body 11, a pair of wedge rings 12A, 12B inserted in joining end portions of the drum sleeve 10 and the drum body 11 to fix the drum sleeve 10 and the drum body 11, and hold-down rings 13 fastened to opposite end surfaces of the drum body 11 to hold down one of the wedge rings, 12B.

FIG. 20 also shows a structure in which the drum sleeve 10 is supported by the drum body 11 located inwardly, and bonding end portions of the drum sleeve 10 and the drum body 11 are joined together by fillet welding 14.

FIG. 21 also shows a structure in which the drum sleeve 10 is supported by the drum body 11 located inwardly, and entire contact surfaces of the drum sleeve 10 and the drum body 11 are joined together by shrink fit 15.

In the cooling drum shown in FIG. 19, however, the axial elongation of the drum sleeve 10 due to thermal deformation (heat load) during casting cannot be restrained merely by the frictional force of the wedge rings 12A, 12B to prevent slippage. As a result, the drum sleeve elongates in the axial direction, and there is no guarantee that its elongation is axially symmetrical with respect to the drum center. Accordingly, a displacement in the axial direction occurs between the end portions of the pair of cooling drums 1, 1, posing the problem that sealing of molten metal between the cooling drums and the side gates 2 is insufficient.

In the cooling drum shown in FIG. 20, the sites of the fillet welding 14 restraining the elongation of the drum sleeve 10 are low in durability, and once either weld zone is destroyed, the drum sleeve 10 does not elongate axially symmetrically with respect to the center. Accordingly, a displacement in the axial direction occurs between the end portions of the pair of cooling drums 1, 1, posing the problem that sealing of molten metal between the cooling drums and the side gates 2 is insufficient.

In the cooling drum shown in FIG. 21, the entire surface of the joining portions of the drum sleeve 10 and the drum body 11 can be clamped. However, even if clamping can be performed most tightly within an elastic deformation of the drum sleeve 10, the elongation force of the drum sleeve 10 during casting is stronger than the frictional force of the joining surfaces, so that slippage occurs at the fitting surfaces. Moreover, there is no guarantee that the drum sleeve 10 elongates axially symmetrically with respect to the center. Accordingly, a displacement in the axial direction occurs between the end portions of the pair of cooling drums 1, 1, posing the problem that sealing of molten metal between the cooling drums and the side gates 2 is insufficient.

Furthermore, a clamping force may be increased during the shrink fit or the clamping to increase sliding resistance, thereby preventing slippage at the fitting surfaces. In this case, there is a risk that the drum sleeve 10 made of the copper alloy will be torn into pieces. To prevent this risk, it was necessary to increase the thickness of the drum sleeve 10 made of the copper alloy.

Thus, it was difficult to introduce forging during the manufacturing process for the drum sleeve 10 made of the copper alloy, and great variations arose in quality. As a result, the surface layer of the drum sleeve 10 made of the copper alloy was rapidly damaged under heat load during casting, presenting the problem that the drum sleeve 10 made of the copper alloy had a short life.

Conventionally, temperature control of the drum body 11 was not performed, so that a drum crown (concave crown) greatly changed under heat load during casting. Thus, there was a problem that a cast piece having an appropriate convex crown (cast piece crown) was not producible.

The object of the present invention is to provide a twin-drum continuous casting apparatus and method which have means for preventing various adverse influences due to differences in thermal expansion of constituent members, thereby increasing the reliability of the apparatus, and improving the quality of casting.

DISCLOSURE OF THE INVENTION

To attain the above object, the invention claims a twin-drum continuous casting apparatus for casting a metal sheet by supplying molten metal to a pouring basin formed by a pair of cooling drums rotating in opposite directions, and side gates, to cool the molten metal by contact with surfaces of the cooling drums, thereby forming a solidified shell, wherein the cooling drum is formed from a drum body having shaft portions at opposite end portions, and a drum sleeve fitted on an outer peripheral portion of the drum body, and means is provided for preventing various adverse influences due to differences in thermal expansion of constituent members of the drum body during casting.

According to this feature, various adverse influences due to differences in thermal expansion of constituent members are prevented, thereby increasing the reliability of the apparatus, and improving the quality of casting.

The drum body is formed from, and divided into, a pair of shaft members having the shaft portions provided integrally therewith and being joined to end portions of the drum sleeve, and a core member located between the shaft members and shrink fitted to an inner peripheral surface of the drum sleeve without contacting the shaft members.

According to this feature, the end portions of the pair of cooling drums can be prevented from axial displacement, and leakage of molten metal can be prevented.

In shrink fit between the drum sleeve and the core member supporting the drum sleeve from inside, a tightening margin at an intermediate portion in a drum axis direction is greater than a tightening margin at the end portion.

According to this feature, the intermediate portion is higher in contact pressure resistance than the end portion, and thus does not slip. On the other hand, the opposite end portions slightly slide, with respect to the intermediate portion of the drum sleeve and the core member, during each rotation of the drum. A great movement of the core member as a whole does not occur.

The wall thickness of the intermediate portion in the drum axis direction of the core member supporting the drum sleeve from inside is larger than the wall thickness of the end portion.

According to this feature, the intermediate portion is higher in contact pressure resistance than the end portion, and thus does not slip. On the other hand, the opposite end portions slightly slide, with respect to the intermediate portion of the drum sleeve and the core member, during each rotation of the drum. A great movement of the core member as a whole does not occur.

The end portions of the drum sleeve and the shaft members are fastened together by bolts.

According to this feature, the tightening margin of the fitting surfaces can be decreased. Thus, the attachment and detachment of the shaft member are easy.

Many hot water channels, each extending in a drum axis direction along joining surfaces of the drum body and the drum sleeve, are formed at least within the drum body at predetermined intervals in a circumferential direction.

According to this feature, a difference in thermal expansion between the core member and the drum sleeve reaching a high temperature during casting is decreased. Thus, a shearing force acting on the shrink fit joining surface between the drum sleeve and the core member becomes lower than the frictional force, bringing about no displacement. As a result, there is no axial displacement between the end portions of the pair of cooling drums, and molten metal leakage can be prevented.

Supply and discharge of hot water into and from the hot water channels are performed via hot water jackets formed along an inner surface of the drum body in order to heat the inner surface of the drum body.

According to this feature, hot water passes on the inner surface of the drum body and through the interior of the drum body. Thus, the entire drum body is heated.

Cooling water, which has flowed through a cooling water hole of the drum sleeve and turned into hot water upon heat exchange, is supplied to the hot water channels.

According to this feature, the supply of hot water from the outside of the cooling drum is not required. Thus, a hot water supply piping into the cooling drum, and so on are unnecessary, and the structure is simplified, lowering the cost for the cooling drum.

Hot water is supplied to the hot water channels before start of casting to preheat the drum.

According to this feature, displacement between the end portions of the pair of cooling drums during casting is rendered inexistent, and the time required for a preparatory operation for initiating casting is markedly shortened.

The drum body is made of SUS, the drum sleeve is made of a Cu alloy, and the SUS drum body is composed of a plurality of ring-shaped core members arranged dividedly at intervals in an axial direction.

According to this feature, inside the Cu alloy drum sleeve, the portions where the SUS core members fitted to the drum sleeve and supporting it are present, and the portions where the SUS core members do not exist are alternately formed. The Cu alloy drum sleeve can freely change in the axial direction in the portions where the SUS core members are not present. In the portions where the SUS core members are present, the axial length of the fitting portion between the Cu alloy drum sleeve and the SUS core members is divided into short lengths, so that relative slide does not occur in the fitting portion. As a result, a tightening force can be decreased in fitting the Cu alloy drum sleeve and the SUS core members, and the Cu alloy drum sleeve can be formed with a small thickness. Thus, the cooling drum lightweight and having a long useful life is obtained.

The Cu alloy drum sleeve is composed of a 60 to 100 mm thick sheet.

According to this feature, compared with the conventional Cu alloy drum sleeve of this type, which has a large wall thickness of 120 to 150 mm, the thickness can be markedly decreased, and weight reduction and prolongation of the useful life are achieved for the Cu alloy drum sleeve.

Of the plural core members provided dividedly, the core members located at opposite end portions of the drum body have axial end surfaces to which drum shafts are fixed, and have circumferential surfaces, which are fitted to the Cu alloy drum sleeve, formed so as to be wider than circumferential surfaces of the core members at an intermediate portion of the drum body, and the core members arranged in the intermediate portion each have a convex small-width portion on a circumferential surface thereof, the convex small-width portion being fitted to the Cu alloy drum sleeve.

According to this feature, the core members at the opposite end portions can withstand a greater load. The core members in the intermediate portion increase in the proportion of the free zone relative to the elongation of the Cu alloy drum sleeve, and the anti-slip effect at the fitting surface is higher. Thus, a preferred cooling drum with a long useful life is obtained which can find sufficient use as a long-bodied, heavy-weight casting drum.

Outer layer water channels are provided in the drum sleeve, inner layer water channels are provided in the drum body, cooling water is supplied to the outer layer water channels and the inner layer water channels, a measuring device is provided for measuring a temperature of cooling water discharged from the inner layer water channels, and a control device is provided for controlling a temperature of cooling water supplied to the inner layer water channels in accordance with the cooling water temperature from the measuring device.

According to this feature, the temperature of cooling water supplied to the inner layer water channels is controlled in accordance with the temperature of cooling water discharged from the inner layer water channels. Thus, crown control of the metal sheet in response to thermal expansion of the cooling drum can be performed with satisfactory response.

Outer layer water channels are provided in the drum sleeve, inner layer water channels are provided in the drum body, cooling water is supplied to the outer layer water channels and the inner layer water channels, a measuring device is provided for measuring a profile in a plate width direction of the metal sheet delivered from the cooling drums, and a control device is provided for controlling a temperature of cooling water supplied to the inner layer water channels in accordance with the profile from the measuring device.

According to this feature, the temperature of cooling water supplied to the inner layer water channels is controlled in accordance with the crown of the metal sheet delivered from the cooling drums. Thus, crown control of the metal sheet responsive to thermal expansion of the cooling drum can be performed with high accuracy.

Outer layer water channels are provided in the drum sleeve, inner layer water channels are provided in the drum body, cooling water is supplied to the outer layer water channels and the inner layer water channels, measuring devices are provided for measuring a temperature of cooling water discharged from the inner layer water channels, and a profile in a plate width direction of the metal sheet delivered from the cooling drums, and a control device is provided for controlling a temperature of cooling water supplied to the inner layer water channels in accordance with the cooling water temperature and the profile from the measuring devices.

According to this feature, the temperature of cooling water supplied to the inner layer water channels is controlled in accordance with the crown of the metal sheet delivered from the cooling drums and the temperature of cooling water discharged from the inner layer water channels. Thus, crown control of the metal sheet responsive to thermal expansion of the cooling drum can be performed with satisfactory response and high accuracy.

In a twin-drum continuous casting apparatus for casting a metal sheet by supplying molten metal to a pouring basin formed by a pair of cooling drums rotating in opposite directions, and side gates, to cool the molten metal by contact with surfaces of the cooling drums, thereby forming a solidified shell, a twin-drum continuous casting method comprising:

forming the cooling drum from a drum body having shaft portions at opposite end portions, and a drum sleeve fitted on an outer peripheral portion of the drum body, and implementing means for preventing various adverse influences due to differences in thermal expansion of constituent members of the drum body during casting, said means being such that many hot water channels, each extending in a drum axis direction along joining surfaces of the drum body and the drum sleeve, are formed at least within the drum body at predetermined intervals in a circumferential direction, and supply and discharge of hot water into and from the hot water channels are performed via hot water jackets formed along an inner surface of the drum body in order to heat the inner surface of the drum body.

According to this feature, a difference in thermal expansion between the core member and the drum sleeve reaching a high temperature during casting is decreased. Thus, a shearing force acting on the shrink fit joining surface between the drum sleeve and the core member becomes lower than the frictional force, bringing about no displacement. As a result, there is no axial displacement between the end portions of the pair of cooling drums, and molten metal leakage can be prevented. Furthermore, hot water passes on the inner surface of the drum body and through the interior of the drum body. Thus, the entire drum body is heated.

A twin-drum continuous casting method comprising:

providing outer layer water channels in a portion of each of cooling drums along a circumferential surface of the cooling drum;

providing inner layer water channels inwardly of the outer layer water channels; and casting a metal sheet while supplying cooling water to the outer layer water channels and the inner layer water channels, and further comprising:

measuring a temperature of cooling water discharged from the inner layer water channels; and controlling a temperature of cooling water supplied to the inner layer water channels in accordance with the measured temperature, thereby controlling crown of the metal sheet.

According to this feature, the temperature of cooling water supplied to the inner layer water channels is controlled in accordance with the crown of the metal sheet delivered from the cooling drums. Thus, crown control of the metal sheet responsive to thermal expansion of the cooling drum can be performed with high accuracy.

A twin-drum continuous casting method comprising:

providing outer layer water channels in a portion of each of cooling drums along a circumferential surface of the cooling drum;

providing inner layer water channels inwardly of the outer layer water channels; and casting a metal sheet while supplying cooling water to the outer layer water channels and the inner layer water channels, and further comprising:

measuring a profile in a plate width direction of the metal sheet delivered from the cooling drums; and controlling a temperature of cooling water supplied to the inner layer water channels in accordance with the measured profile, thereby controlling crown of the metal sheet.

According to this feature, the temperature of cooling water supplied to the inner layer water channels is controlled in accordance with the crown of the metal sheet delivered from the cooling drums. Thus, crown control of the metal sheet responsive to thermal expansion of the cooling drum can be performed with high accuracy.

A twin-drum continuous casting method comprising:

providing outer layer water channels in a portion of each of cooling drums along a circumferential surface of the cooling drum;

providing inner layer water channels inwardly of the outer layer water channels; and casting a metal sheet while supplying cooling water to the outer layer water channels and the inner layer water channels, and further comprising:

measuring a temperature of cooling water discharged from the inner layer water channels, and a profile in a plate width direction of the metal sheet delivered from the cooling drums; and controlling a temperature of cooling water supplied to the inner layer water channels in accordance with the temperature of cooling water and the profile, thereby controlling crown of the metal sheet.

According to this feature, the temperature of cooling water supplied to the inner layer water channels is controlled in accordance with the crown of the metal sheet delivered from the cooling drums and the temperature of cooling water discharged from the inner layer water channels. Thus, crown control of the metal sheet responsive to thermal expansion of the cooling drum can be performed with satisfactory response and high accuracy.

BEST MODE FOR CARRYING OUT THE INVENTION

The twin-drum continuous casting apparatus according to the present invention will now be described in detail by embodiments with reference to the drawings.

[First Embodiment]

Figure 1:
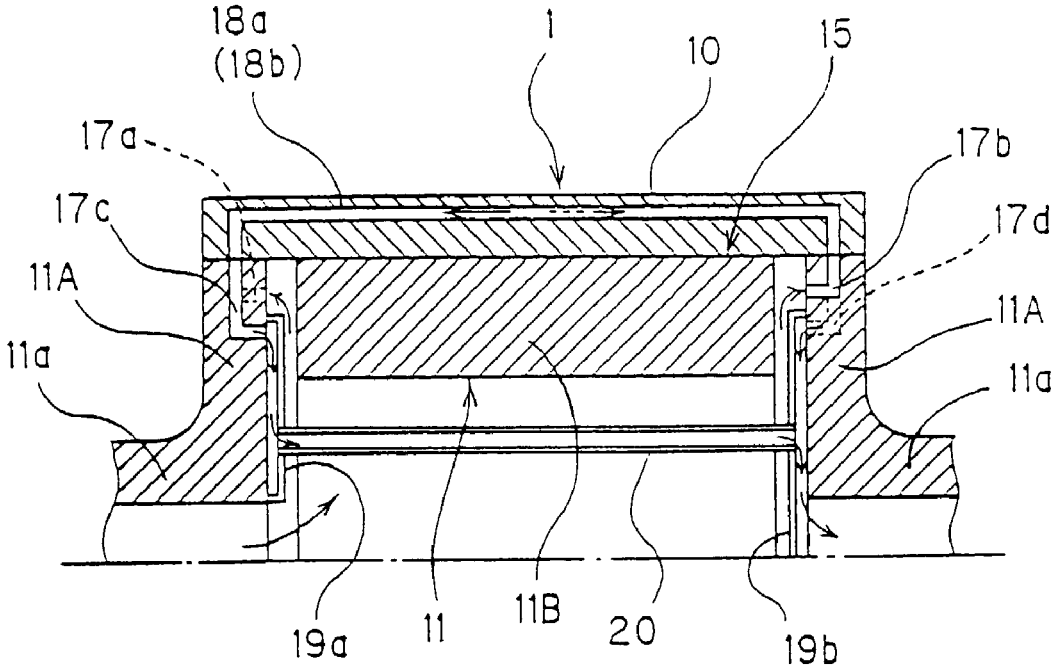
FIG. 1 is a sectional view of an internal structure of a cooling drum showing a first embodiment of the present invention.
Figure 2:
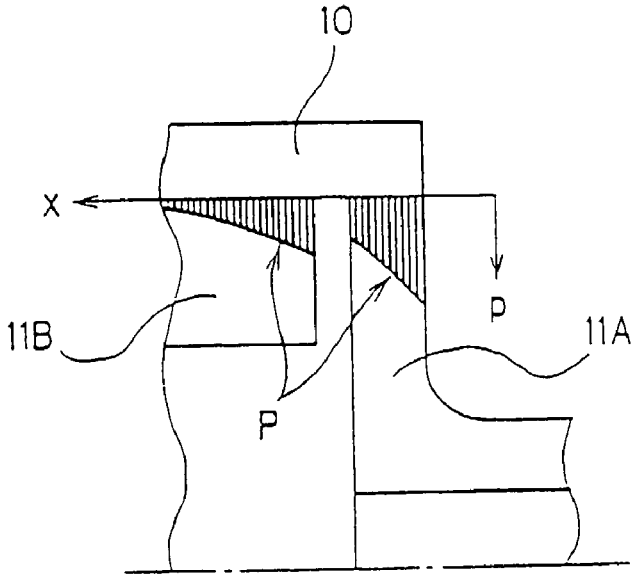
FIG. 2 is an explanation drawing of a surface pressure distribution at fitting surfaces of an end portion of the cooling drum.

FIG. 1 is a sectional view of an internal structure of a cooling drum showing a first embodiment of the present invention. FIG. 2 is an explanation drawing of a surface pressure distribution at fitting surfaces of an end portion of the cooling drum.

As shown in FIG. 1, a cooling drum 1 includes a drum body 11 having hollow shaft portions 11*a* at opposite end portions, and a drum sleeve 10 fitted on an outer peripheral portion of the drum body 11. The drum body 11 is formed from, and divided into, a pair of shaft members 11A having the hollow shaft portions 11*a* formed integrally therewith and being joined to end portions of the drum sleeve 10, and a core member 11B located between the shaft members 11A and shrink fitted to an inner peripheral surface of the drum sleeve 10 without contacting the shaft members 11A.

The drum sleeve 10 uses a material (e.g., a copper alloy) provided with high strength by solution heat treatment, followed by cold forging and aging treatment, and is joined to the core member 11B by shrink fit 15. At this time, tightening margin (by impartment of a crown) of the shrink fit joining surfaces at the intermediate portion in the axial direction of the drum is set at about 1.2 times the tightening margin of the end portion.

Joining of the pair of shaft members 11A and the drum sleeve 10 is performed by shrink fit, and the tightening margin of the joining surface is somewhat smaller than that in the shrink fit between the core member 11B and the drum sleeve 10. A rigid material (e.g., stainless steel) is used for the shaft member 11A and the core member 11B.

Cooling water is flowed in through the hollow shaft portion 11*a* of one of the shaft members 11A, and discharged through the hollow shaft portion 11*a* of the other shaft member 11A. In the interior of the cooling drum 1, cooling water moves along two-route cooling water systems.

In one of the routes, cooling water flowing in through the hollow shaft portion 11*a* of one of the shaft members 11A is passed through a cooling water hole 17*a* inside the one shaft member 11A, and guided into a cooling water hole 18*b* within the drum sleeve 10. In the cooling water hole 18*b*, cooling water takes away heat accumulated in the drum sleeve 10. Then, the cooling water is passed through a cooling water hole 17*d* within the other shaft member 11A and a cooling water jacket 19*b*, and discharged to the outside of the cooling drum through the hollow shaft portion 11*a* of the other shaft member 11A.

In the other route, cooling water is guided into a cooling water hole 18*a* within the drum sleeve 10 through a cooling water hole 17*b* inside the other shaft member 11A. In the cooling water hole 18*a*, cooling water takes away heat accumulated in the drum sleeve 10. Then, cooling water passes through a cooling water hole 17*c* within the one shaft member 11A and a cooling water jacket 19*a*, further passes through a cooling water piping 20, and arrives at the cooling water jacket 19*b* of the other shaft member 11A. From there, cooling water is discharged to the outside of the cooling drum through the hollow shaft portion 11*a* of the other shaft member 11A.

There are the two-route cooling water systems arranged in the circumferential direction of the cooling drum 1, with the two routes located alternately circumferentially. Thus, cooling water flowing in the cooling water holes 18*a*, 18*b* within the drum sleeve 10 forms counter flows.

According to the cooling drum 1 of the thus constituted twin-drum continuous casting apparatus, the drum sleeve 10 and the core member 11B are joined together by the shrink fit 15. Thus, shear stress acting on the drum sleeve 10 and the core member 11B during casting increases because of a difference in thermal expansion, thereby causing slippage of the joining surfaces. In the present structure, however, the core member 11B and the pair of shaft members 11A are separate members, and are out of contact with each other. Moreover, the length of the fitting surface of the shaft member 11A is short. Thus, a contact pressure pattern, p, as shown in FIG. 2 appears during casting. As a result, the inner fitting surface (the surface facing the intermediate portion in the axial direction of the drum) of the shaft member 11A slips, while the outer fitting surface thereof does not slip. Consequently, relative displacement in the axial direction of the drum end surfaces with respect to bearings of the pair of cooling drums 1 is inexistent.

Furthermore, the tightening margin of the joining surfaces in the intermediate portion in the drum axis direction of the drum sleeve 10 and the core member 11B is set to be about 1.2 times the tightening margin of the end portion. Hence, the intermediate portion is higher in contact pressure resistance than the end portion, and thus does not slip. On the other hand, the opposite end portions slightly slide, with respect to the intermediate portion of the drum sleeve 10 and the core member 11B, during each rotation of the drum. Hence, a great movement of the core member 11B as a whole does not occur.

[Second Embodiment]

Figure 3:
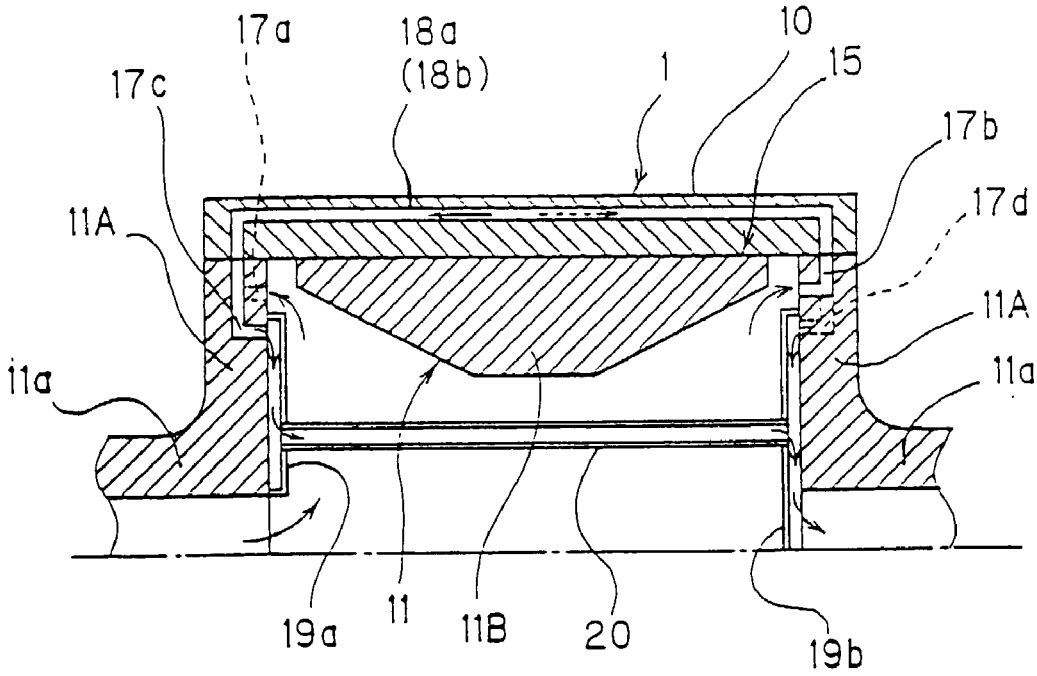
FIG. 3 is a sectional view of an internal structure of a cooling drum showing a second embodiment of the present invention.

FIG. 3 is a sectional view of an internal structure of a cooling drum showing a second embodiment of the present invention.

This is an embodiment in which the wall thickness of the intermediate portion in the drum axis direction of the core member 11B, where a tightening margin for shrink fit is to be increased, is made larger than the wall thickness of the end portion to maintain a high contact pressure resistance. This embodiment shows the same effects as does the First Embodiment.

[Third Embodiment]

Figure 4:
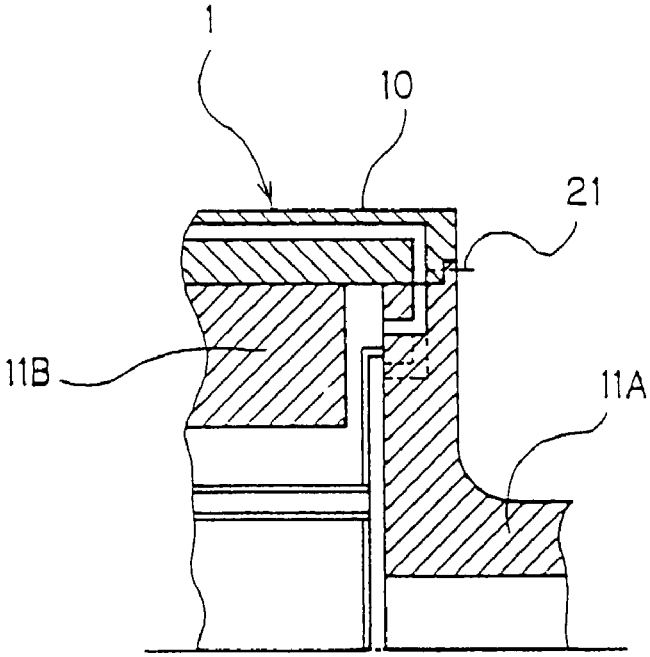
FIG. 4 is a sectional view of an end structure of a cooling drum showing a third embodiment of the present invention.

FIG. 4 is a sectional view of an end structure of a cooling drum showing a third embodiment of the present invention.

This is an embodiment in which the method for joining of the drum sleeve 10 and the shaft member 11A is changed from shrink fit to tightening by a bolt 21. According to this embodiment, the tightening margin at the fitting surfaces can be decreased. Thus, the advantage that the attachment and detachment of the shaft member 11A are easy is obtained, in addition to the same effects as in the First Embodiment.

[Fourth Embodiment]

Figure 5:
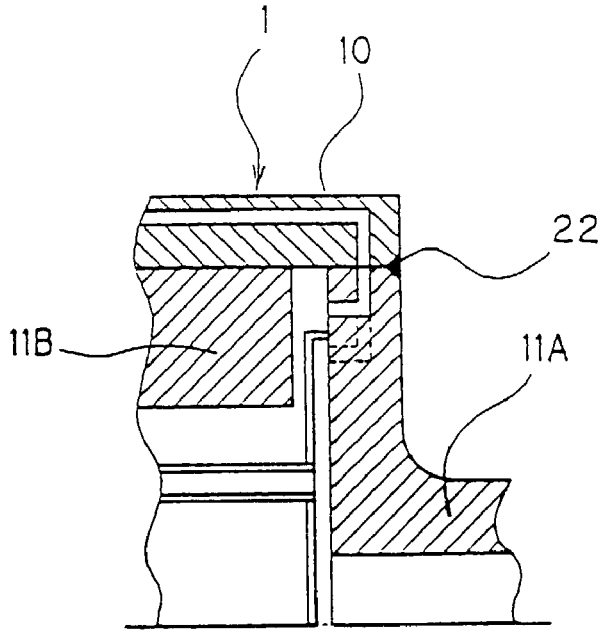
FIG. 5 is a sectional view of an end structure of a cooling drum showing a fourth embodiment of the present invention.

FIG. 5 is a sectional view of an end structure of a cooling drum showing a fourth embodiment of the present invention.

This is an embodiment in which joining of the drum sleeve 10 and the shaft member 11A is performed by welding 14. According to this embodiment, the advantage that a joining operation is performed easily and promptly is obtained, in addition to the same effects as in the First Embodiment.

[Fifth Embodiment]

Figure 6:
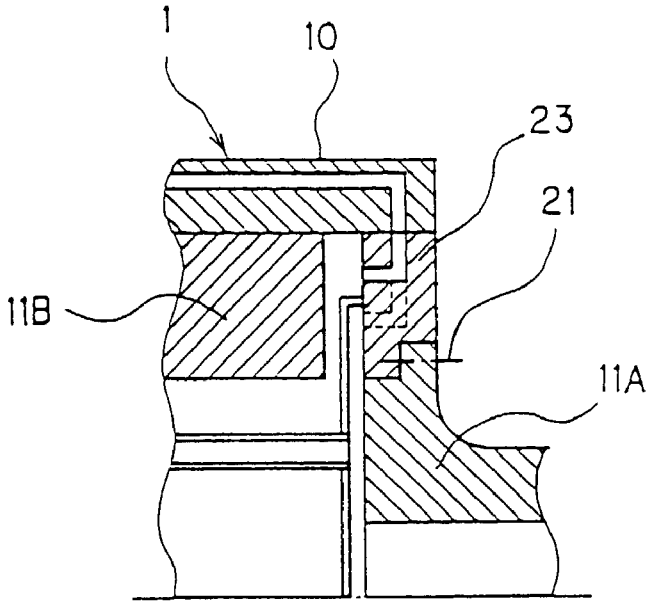
FIG. 6 is a sectional view of an end structure of a cooling drum showing a fifth embodiment of the present invention.

FIG. 6 is a sectional view of an end structure of a cooling drum showing a fifth embodiment of the present invention.

This is an embodiment in which the drum sleeve 10 is supported by a steel ring 23 bonded to the shaft member 11A by a bolt 21. According to this embodiment, the advantage that there is the degree of freedom in the selection of a material for the shaft member 11A is obtained, in addition to the same effects as in the First Embodiment.

[Six Embodiment]

Figure 7:
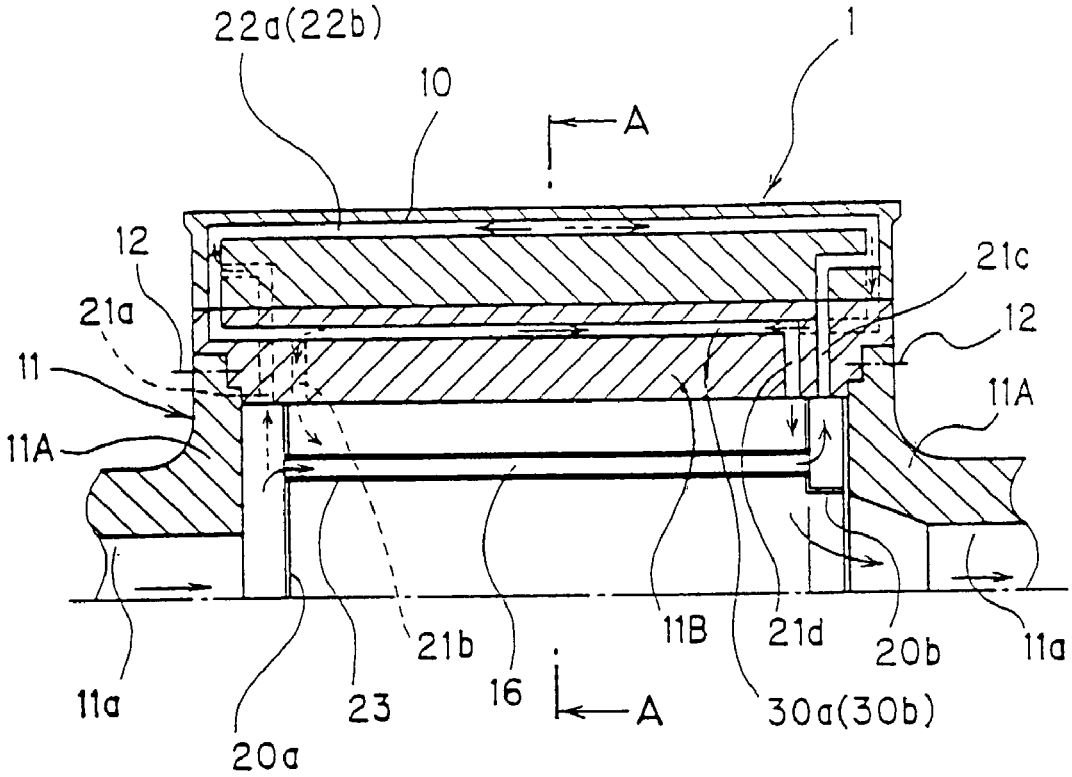
FIG. 7 is a sectional view of an internal structure of a cooling drum showing a sixth embodiment of the present invention.
Figure 8:
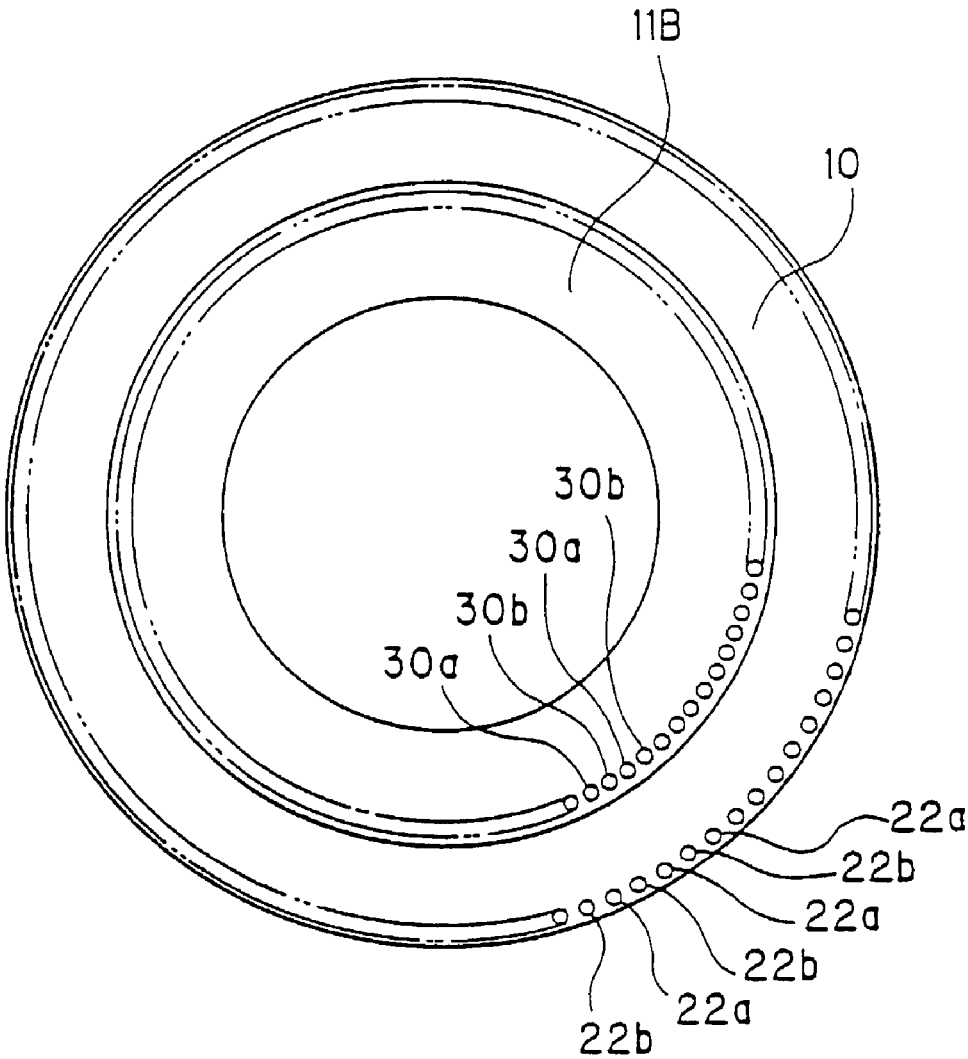
FIG. 8 is a sectional view taken on line A—A of FIG. 7.
Figure 9:
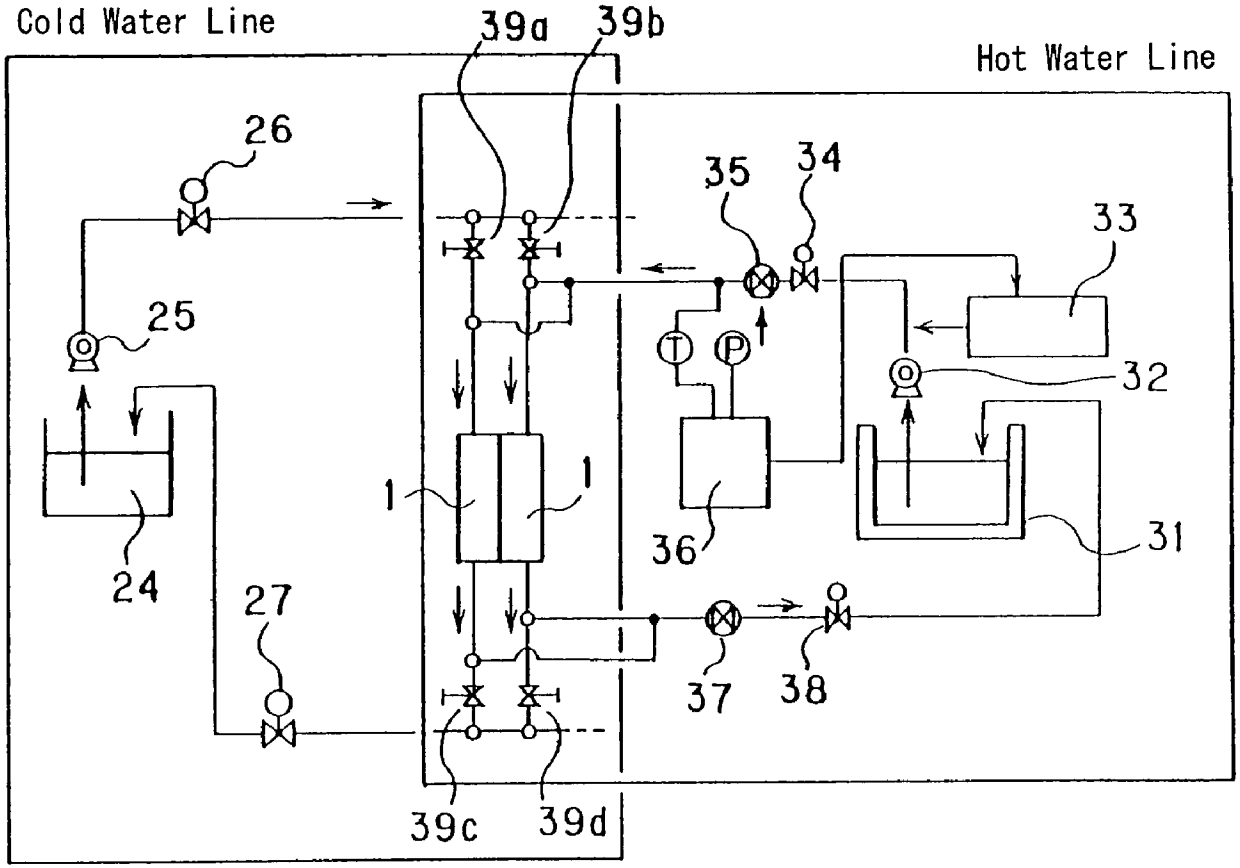
FIG. 9 is a schematic configuration drawing of a cold water line and a hot water line for the cooling drums.

FIG. 7 is a sectional view of an internal structure of a cooling drum showing a sixth embodiment of the present invention. FIG. 8 is a sectional view taken on line A—A of FIG. 7. FIG. 9 is a schematic configuration drawing of a cold water line and a hot water line.

As shown in FIGS. 7 and 8, the present embodiment does not supply hot water from the outside of the cooling drum during casting, but utilizes cooling water which has become hot water after heat exchange. There are two routes for cooling water guided into the cooling drum.

In one of the routes, cooling water of about 25° C., which has flowed in through a hollow shaft portion 11*a* of one of shaft members 11A, enters a cooling water jacket 20*a*. From there, cooling water is guided into a cooling water hole 22*b* within a drum sleeve 10 through a cooling water hole 21*a* formed in a core member 11B, the cooling water hole 21*a* located beside the one shaft member 11A. In the cooling water hole 22*b*, cooling water takes away heat accumulated in the drum sleeve 10, warming to about 43° C. Then, cooling water passes through a hot water channel 30*b* extending within the core member 11B in the drum axis direction along joining surfaces between the core member 11B and the drum sleeve 10, and arrives at a space inward of the core member 11B past a cooling water hole 21*b* formed in the core member 11B, the cooling water hole 21*b* located beside the one shaft member 11A. From there, cooling water is discharged to the outside of the cooling drum through the hollow shaft portion 11*a* of the other shaft member 11A.

In the other route, cooling water passes through a cooling water piping 23 from the cooling water jacket 20*a*, and enters another cooling water jacket 20*b* formed beside the other shaft member 11A. From there, cooling water is guided into a cooling water hole 22*a* within the drum sleeve 10 through a cooling water hole 21*c* formed in the core member 11B, the cooling water hole 21*c* located beside the other shaft member 11A. In the cooling water hole 22*a*, cooling water takes away heat accumulated in the drum sleeve 10, warming to about 43° C. Then, the warmed water passes through a hot water channel 30*a* extending within the core member 11B in the drum axis direction along joining surfaces between the core member 11B and the drum sleeve 10, and arrives at the space inward of the core member 11B past a cooling water hole 21*d* formed in the core member 11B, the cooling water hole 21*d* located beside the other shaft member 11A. From there, the warmed water is discharged to the outside of the cooling drum through the hollow shaft portion 11*a* of the other shaft member 11A.

Figure 18:
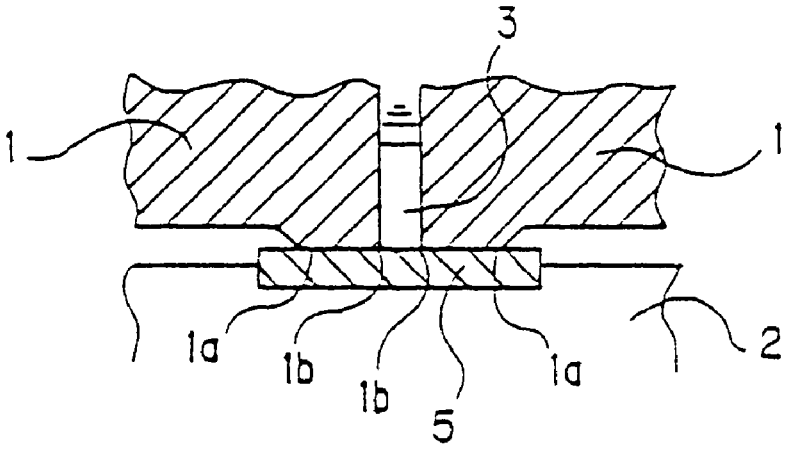
Fig. 18 CONVENTIONAL ART
FIG. 18 is an enlarged sectional view taken on line D—D of FIG. 17, showing a sliding portion of a side gate in sliding contact with end portions of the cooling drums at a kissing point at which the surfaces of the pair of cooling drums are closest to each other.
Figure 19:
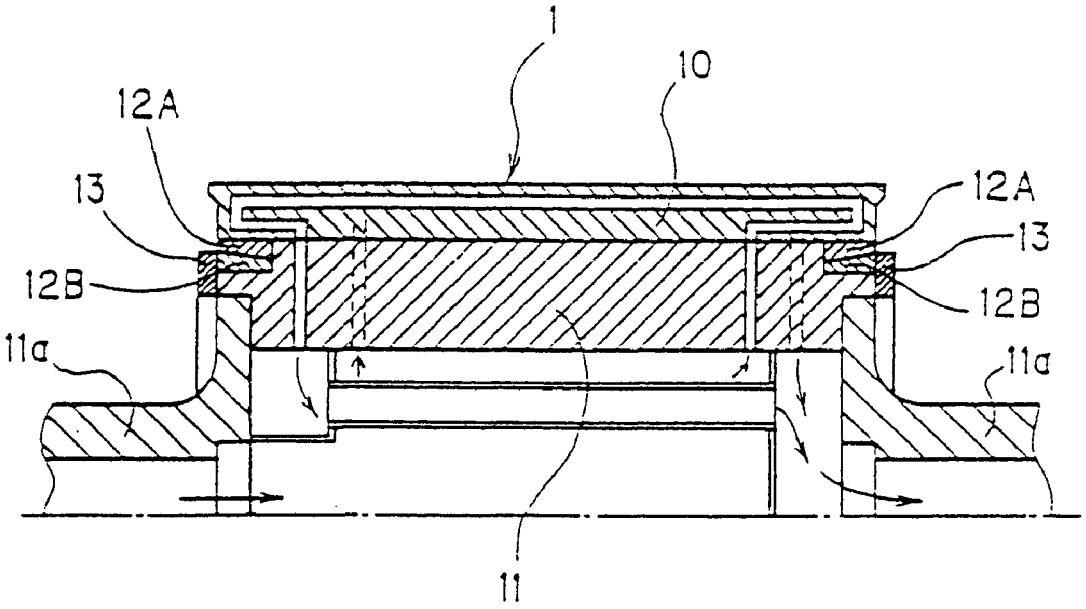
Fig. 19 CONVENTIONAL ART
FIG. 19 is a sectional view of an internal structure of a cooling drum as a conventional example.

According to this route, the internal space of the core member 11B is filled with cooling water of about 43° C. which has finished heat exchange. The above two types of routes for cooling water are arranged alternately in the circumferential direction of the cooling drum 1. Thus, cooling water flowing through the cooling water holes 22*a*, 22*b* within the drum sleeve 10, and cooling water after heat exchange which flows through the hot water channels 30*a*, 30*b* within the core member 11B form counter flows (see FIG. 8). Other features are the same as in the conventional example shown in FIG. 18.

According to the present embodiment, as described above, hot water for heating the core member 11B is cooling water which has warmed up within the drum sleeve 10. Thus, cooling water warming up in the drum sleeve 10 becomes about 43° C., and is capable of heating the core member 11B sufficiently.

Because of this advantage, a difference in thermal expansion between the core member 11B and the drum sleeve 10 reaching a high temperature during casting is decreased. Thus, a shearing force acting on the shrink fit joining surfaces between the drum sleeve 10 and the core member 11B becomes lower than the frictional force, bringing about no displacement. As a result, there is no relative displacement at the end portions of the drum sleeves 10 of the pair of cooling drums 1, and a poor seal between the ends of the cooling drums and the side gate 2 can be prevented.

Furthermore, the present embodiment does not require the supply of hot water from the outside of the cooling drum 1. Thus, a hot water supply piping into the cooling drum 1, and so on are unnecessary, and the structure is simplified, lowering the cost for the cooling drum 1.

In the present embodiment, as shown in FIG. 9, hot water is supplied to and circulated through the aforementioned two types of cooling water routes before initiation of casting, thereby preheating the drum.

That is, a hot water line for supplying and circulating hot water by switching (closing) shut-off valves 39*a* to 39*d* before start of casting is provided in addition to a cold water line for supplying cooling water to the above-mentioned two types of cooling water routes during casting, the hot water line comprising a pit 31, a pump 32, a steam supply source 33, a valve 34, check valves 35, 37, and a valve 38, and the cold water line comprising a pit 24, a pump 25, and valves 26 and 27.

The temperature of the hot water is controlled by detecting the temperature and pressure of hot water downstream from the check valve 35, and controlling the amount of steam feed from the steam supply source 33 by means of a controller 36 (or an operator) on the basis of the detected values of the temperature and pressure.

In the above-described manner, the drum is preheated in order to decrease the difference in temperature between the core member 11B and the drum sleeve 10 during casting as quickly as possible. By so doing, the aforementioned displacement during casting is rendered inexistent, and the time required for a preparatory operation for initiating casting is markedly shortened.

[Seventh Embodiment]

Figure 10:
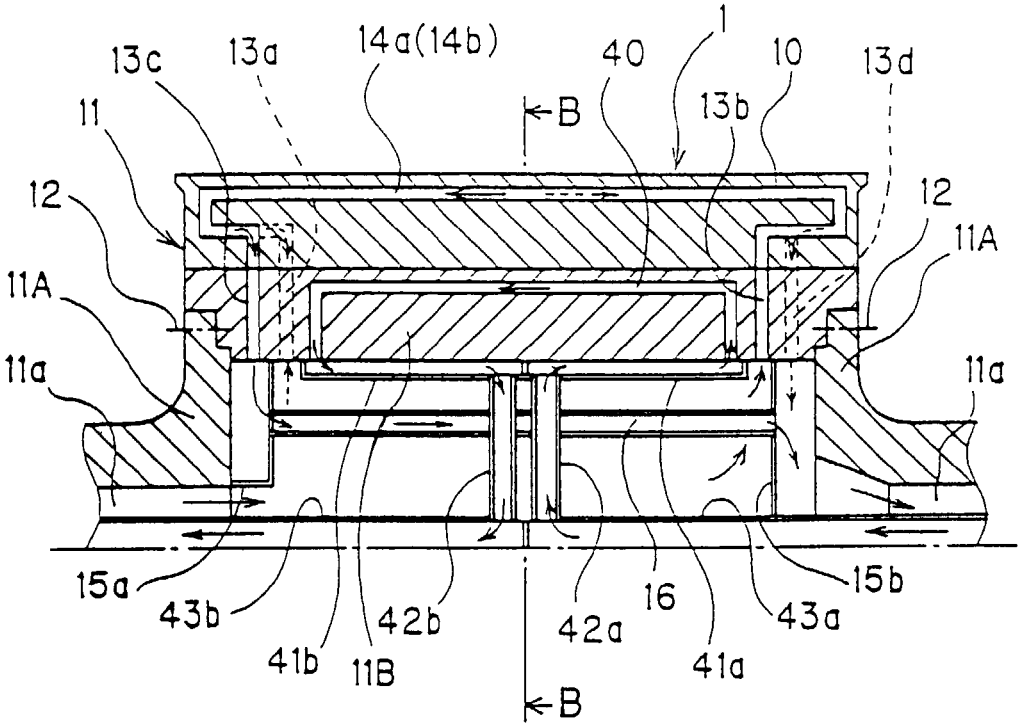
FIG. 10 is a sectional view of an internal structure of a cooling drum showing a seventh embodiment of the present invention.
Figure 11:
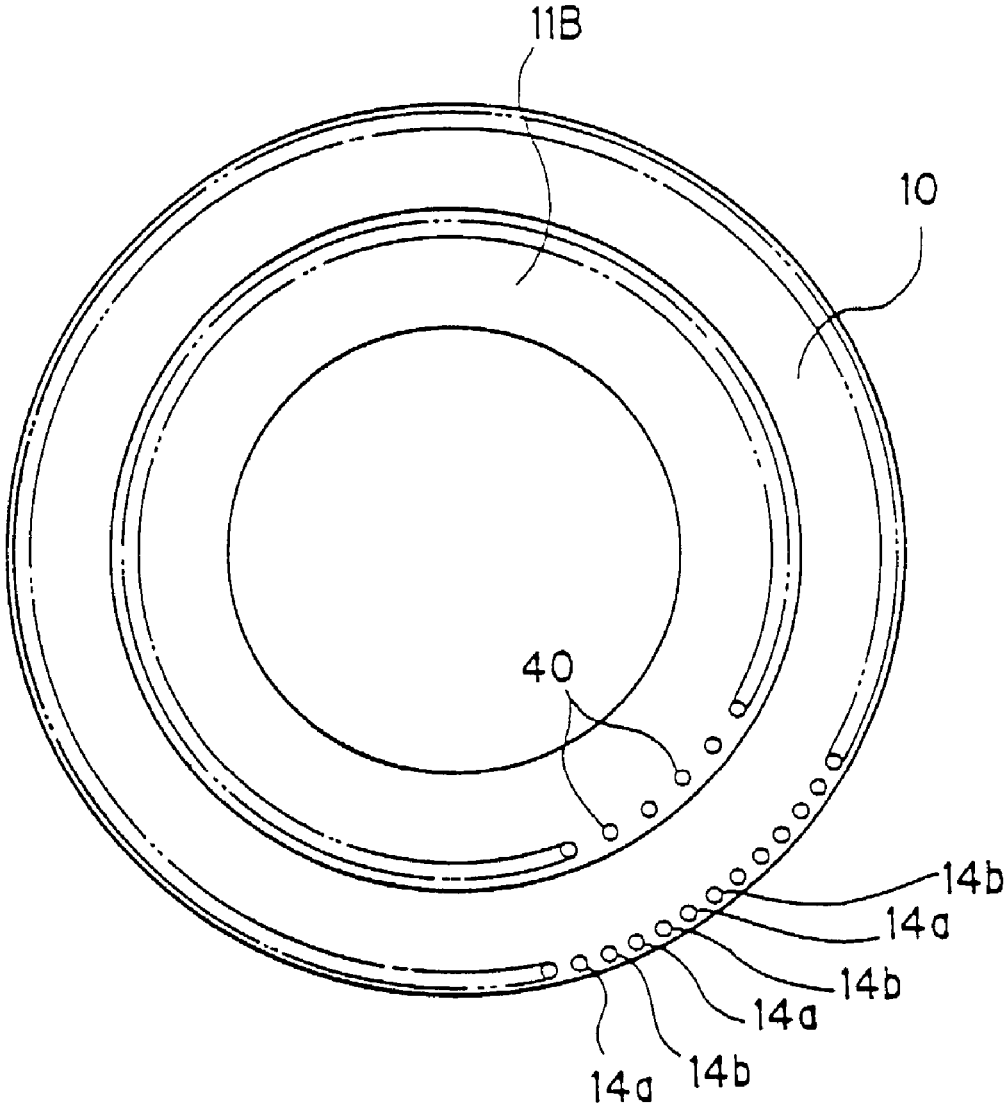
FIG. 11 is a sectional view taken on line B—B of FIG. 10.

FIG. 10 is a sectional view of an internal structure of a cooling drum showing a seventh embodiment of the present invention. FIG. 11 is a sectional view taken on line B—B of FIG. 10.

Figure 20:
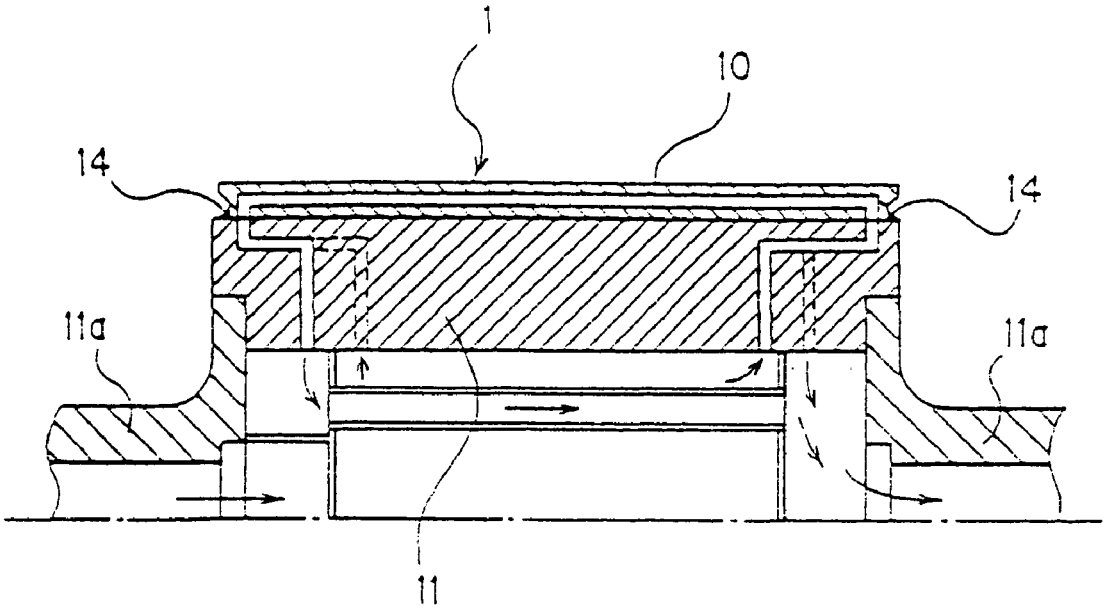
Fig. 20 CONVENTIONAL ART
FIG. 20 is a sectional view of an end structure of a cooling drum as a different conventional example.
Figure 21:
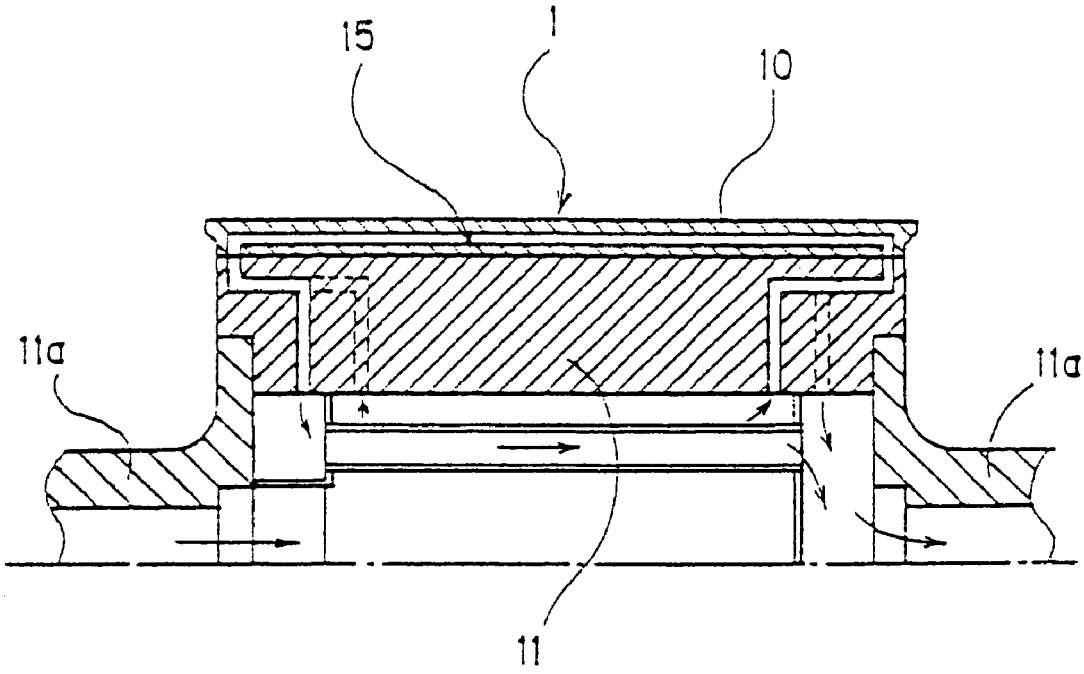
Fig. 21 CONVENTIONAL ART
FIG. 21 is a sectional view of an end structure of a cooling drum as a different conventional example.

This embodiment is an embodiment in which the aforementioned two types of cooling water routes are the same as those in FIGS. 20 and 21 showing the earlier technologies, but many hot water channels 40, each extending in the drum axis direction along joining surfaces of the core member 11B and the drum sleeve 10, are formed within the core member 11B at predetermined intervals in the circumferential direction.

The supply and discharge of hot water into and from the hot water channel 40 are performed via a pair of hot water jackets 4l*a*, 41*b* arranged side by side on the inner surface of the core member 11B, a supply piping 43*a* and a return piping 43*b* piercing through a pair of hollow shaft portions 11*a* of the cooling drum 1, and a plurality of supply pipes 42*a* and return pipes 42*b* disposed in the radial direction of the drum so as to connect the hot water jackets 4l*a*, 41*b* to the supply piping 43*a* and the return piping 43*b*.

Thus, hot water for heating the core member 11B is guided into the cooling drum through the supply piping 43*a* installed within the hollow shaft portion 11*a* of the other shaft member 11A concentrically with the hollow shaft portion 11*a*. Hot water, guided to nearly the center of the cooling drum 1 by the supply piping 43*a*, passes through the plurality of supply pipes 42*a* extending radially of the drum. Then, the hot water is guided to the hot water jacket 41*a* installed on the inner surface of the core member 11B to heat the inner surface of the core member 11B. The hot water passes through the hot water holes 40 within the core member 11B to heat the joining surface of the core member 11B joined to the drum sleeve 10. Then, the hot water is guided to the hot water jacket 41*b* to heat the inner surface of the core member 11B, and is passed through the plurality of return pipes 42*b*. Then, the hot water is guided into the return piping 43*b* installed within the hollow shaft portion 11*a* of the one shaft member 11A concentrically with the hollow shaft portion 11*a*, and is discharged to the outside of the cooling drum.

According to the so constituted cooling drum 1 of the drum continuous casting machine, hot water of about 43° C. passes on the inner surface of the core member 11B and through the interior of the core member 11B. Thus, the entire core member 11B is heated to decrease a difference in thermal expansion between the core member 11B and the drum sleeve 10 reaching a high temperature during casting. Hence, a shearing force acting on the shrink fit joining surfaces of the drum sleeve 10 and the core member 11B becomes lower than the frictional force, thus bringing about no displacement. As a result, there is no relative displacement between the end portions of the drum sleeves 10 of the pair of cooling drums 1, and a poor seal between the ends of the cooling drums and the side gate 2 can be prevented.

In the present embodiment, like the Sixth Embodiment, the drums are preheated. In this case, however, hot water is not passed through the aforementioned two types of cooling water routes, but is passed only through the hot water channels 40, unlike the Sixth Embodiment.

[Eighth Embodiment]

Figure 12:
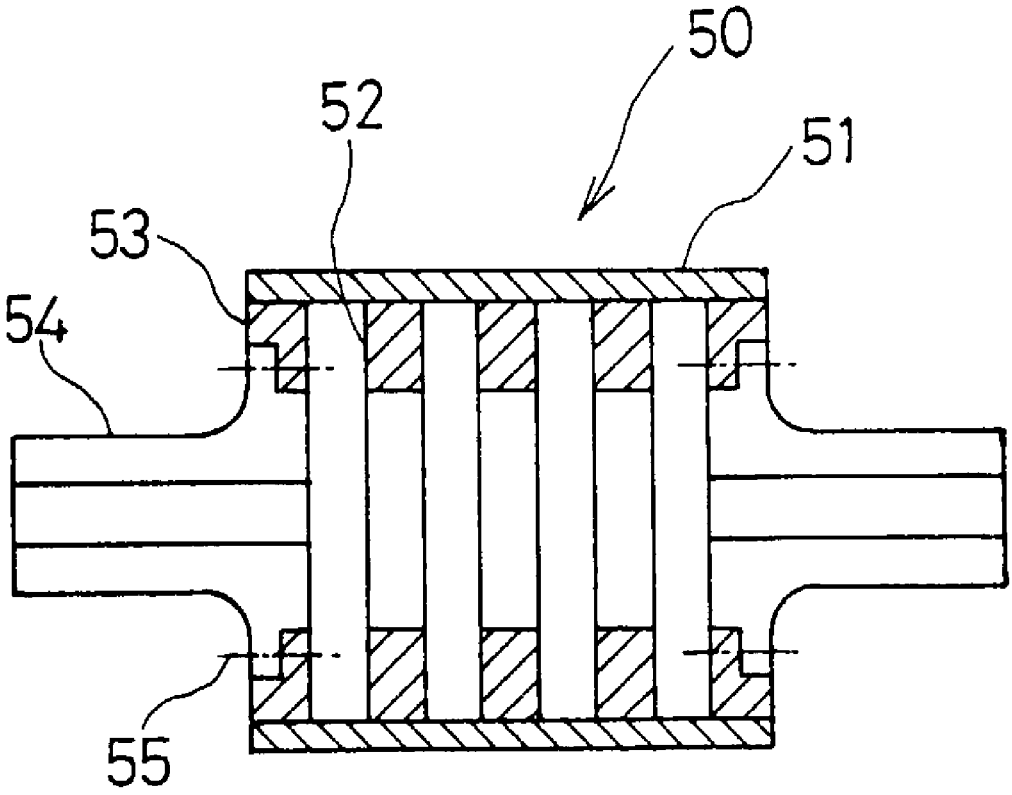
FIG. 12 is a sectional view of an internal structure of a cooling drum showing an eighth embodiment of the present invention.

FIG. 12 is a sectional view of an internal structure of a cooling drum showing an eighth embodiment of the present invention.

In the present embodiment, the numeral 50 denotes a cooling drum. The cooling drum 50 includes a drum sleeve 51 of a Cu alloy, and a plurality of ring-shaped cores 52 of SUS arranged dividedly at intervals in the axial direction inwardly of the drum sleeve 51 of the Cu alloy and fitted on the inner surface of the Cu alloy drum sleeve 51 by shrink fit. Of them, the SUS cores 53 located at opposite end portions have axial end surfaces to which drum shafts 54 are bonded by bolts 55.

The Cu alloy drum sleeve 51 fitted with the ring-shaped SUS cores 52, 53 has a wall thickness of about 80 mm out of consideration for the fact that the temperature of molten steel handled by the twin-drum continuous casting apparatus is about 1,350 to 1,450° C. This plate thickness can be selected from the range of 60 to 100 mm.

The plurality of ring-shaped SUS cores 52 provided dividedly can be selected in suitable numbers according to the length of the drum body of the cooling drum 50 produced. The axial length of the interval portion, at which the SUS core 52 is not fitted to the Cu alloy drum sleeve 51, is larger than the length of the width portion of each ring-shaped core 52 fitted on the inner surface of the Cu alloy drum sleeve 51.

In the cooling drum 50 of the present embodiment constituted in the above manner, when the Cu alloy drum sleeve 51 elongates axially under heat load during a casting operation, the interval between the adjacent ring-shaped SUS cores 52 freely changes, so that slippage of the Cu alloy drum sleeve 51 relative to each SUS core 52 is dissolved.

At the sites where the inner surface of the Cu alloy drum sleeve 51 and the circumferential surfaces of the ring-shaped SUS cores 52 are fitted together, the width (axial length) of the fitting portion is so small that relative slippage of the Cu alloy drum sleeve 51 within the width of the fitting portion does not occur.

Thus, there is no need to apply a strong clamping force to the fitting portion out of concern for relative slippage between the Cu alloy drum sleeve 51 and the SUS core 52 in the fitting portion. Nor is it necessary to increase the thickness of the Cu alloy drum sleeve 51 for fear of breakage by the clamping force. The Cu alloy drum sleeve 51 can be thinned.

According to the findings obtained by the inventors as a result of trial and error, the Cu alloy drum sleeve 51 effectively has a plate thickness of 60 to 100 mm, and particularly preferably has a wall thickness of about 80 mm, in connection with the relationship of the thickness to the temperature of molten steel and other operating conditions, if the temperature of the molten steel handled by the twin-drum continuous casting apparatus relevant to the present embodiment is 1350 to 1450° C.

As described above, the Cu alloy drum sleeve 51 in the present embodiment, compared with a large plate thickness of 120 to 150 mm, generally about 140 mm, in the aforementioned conventional apparatus, has a plate thickness which can be decreased to about a half of the above value. Moreover, forging can be effected markedly during the manufacturing process for the Cu alloy drum sleeve 51. Thus, the Cu alloy drum sleeve 51 of stabilized quality is obtained, and can achieve a longer service life than in the earlier technologies.

Also, the Cu alloy drum sleeve 51 has a small plate thickness, and thus the material cost of the Cu alloy is low. Further, the operating time for the fitting step is shortened, facilitating the fitting operation.

The present embodiment, therefore, gives the effects that a high durability (long life), thin-walled, lightweight cooling drum 50 free from slippage at the fitting surface can be provided inexpensively, and the productivity of the twin-drum continuous casting apparatus can be increased.

[Ninth Embodiment]

Figure 13:
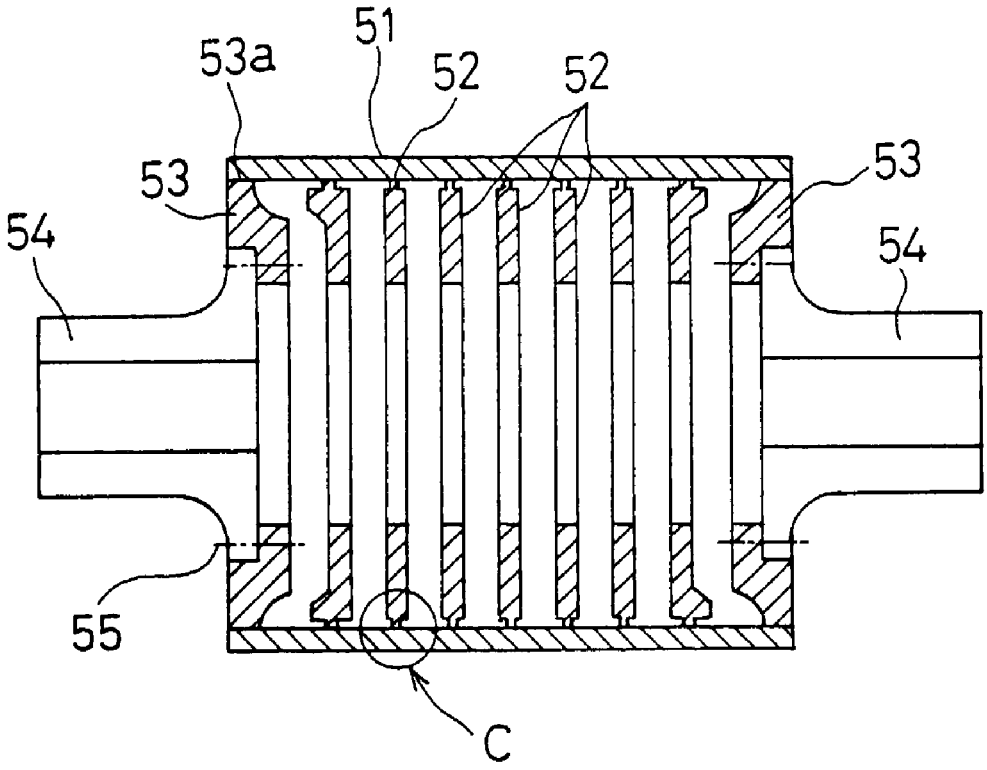
FIGS. 13(*a*) and 13(*b*) show a cooling drum according to a ninth embodiment of the present invention, FIG. 13(*a*) being a longitudinal sectional view of the cooling drum, and FIG. 13(*b*) being an enlarged view of a portion C in FIG. 13(*a*).
Figure 13:
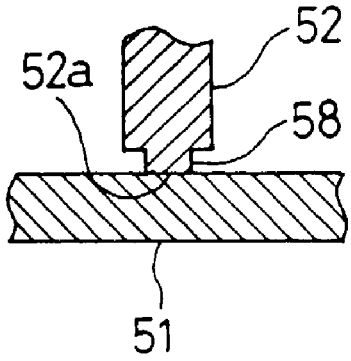

FIGS. 13(*a*) and 13(*b*) show a cooling drum according to a ninth embodiment of the present invention, FIG. 13(*a*) being a longitudinal sectional side view of the cooling drum, and FIG. 13(*b*) being an enlarged view of a portion C in FIG. 13(*a*).

To avoid a verbose explanation, the sites of the same constitution as in the aforementioned Eighth Embodiment are indicated by the same numerals in the drawings, duplicate explanations are omitted if possible, and the points characteristic of the present embodiment are emphatically described.

The present embodiment is preferred for use as a cooling drum with a long body and a heavy weight. The cooling drum includes a plurality of ring-shaped cores 52 of SUS arranged dividedly at intervals in the axial direction. Of them, the SUS cores 53 located at opposite end portions in order to have drum shafts 54 connected thereto are slightly thicker in plate thickness than the other SUS cores 52 arranged in the intermediate portion. The SUS cores 53 are formed in a ring shape having a slightly wide circumferential surface 53*a* fitted on the inner surface of an end portion of a drum sleeve 51 of a Cu alloy. The other ring-shaped SUS cores 52 arranged in the intermediate portion have a convex small-width portion 58 on a circumferential surface 52*a* thereof. The convex small-width portions 58 allow the ring-shaped cores to be fitted to the Cu alloy drum sleeve 51 at spaced apart positions in the axial direction.

In the cooling drum with the long body and heavy weight, a heavier load is imposed on the ring-shaped SUS cores 53 provided in a divided manner and arranged at the opposite end portions to which the drum shafts 54 are connected.

In the present embodiment, therefore, the circumferential surface 53*a* of each of the ring-shaped SUS cores 53 provided in a divided manner at the opposite end portions is made slightly thicker and wider than the circumferential surface 52*a* of each of the other SUS cores 52 arranged in the intermediate portion. These circumferential surfaces 53*a* are fitted to the Cu alloy drum sleeve 51 to take charge of the necessary strength.

The SUS cores 52 arranged dividedly in the axial direction in the intermediate portion have the convex small-width portion 58 on the circumferential surface 52*a*, and is fitted to the Cu alloy drum sleeve 51 at the body convex small-width portion 58. Thus, there is an increase in the proportion of the free zone relative to the elongation of the Cu alloy drum sleeve 51, and the anti-slip effect at the fitting surfaces is higher and more reliable, so that the safety of the long-bodied cooling drum can be promoted.

[Tenth Embodiment]

Figure 14:
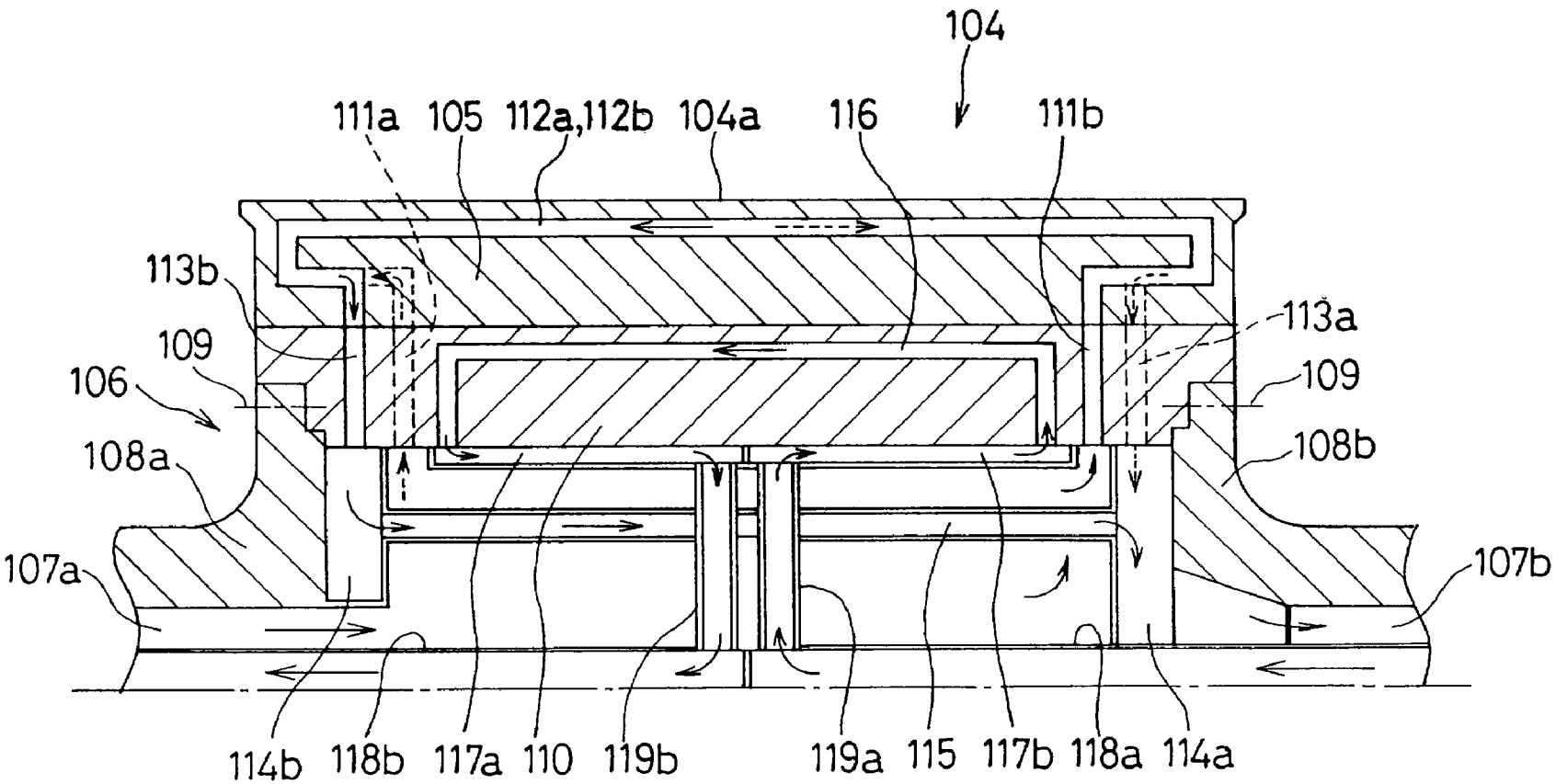
FIG. 14 is a sectional view of an internal structure of a cooling drum showing a tenth embodiment of the present invention.
Figure 15:
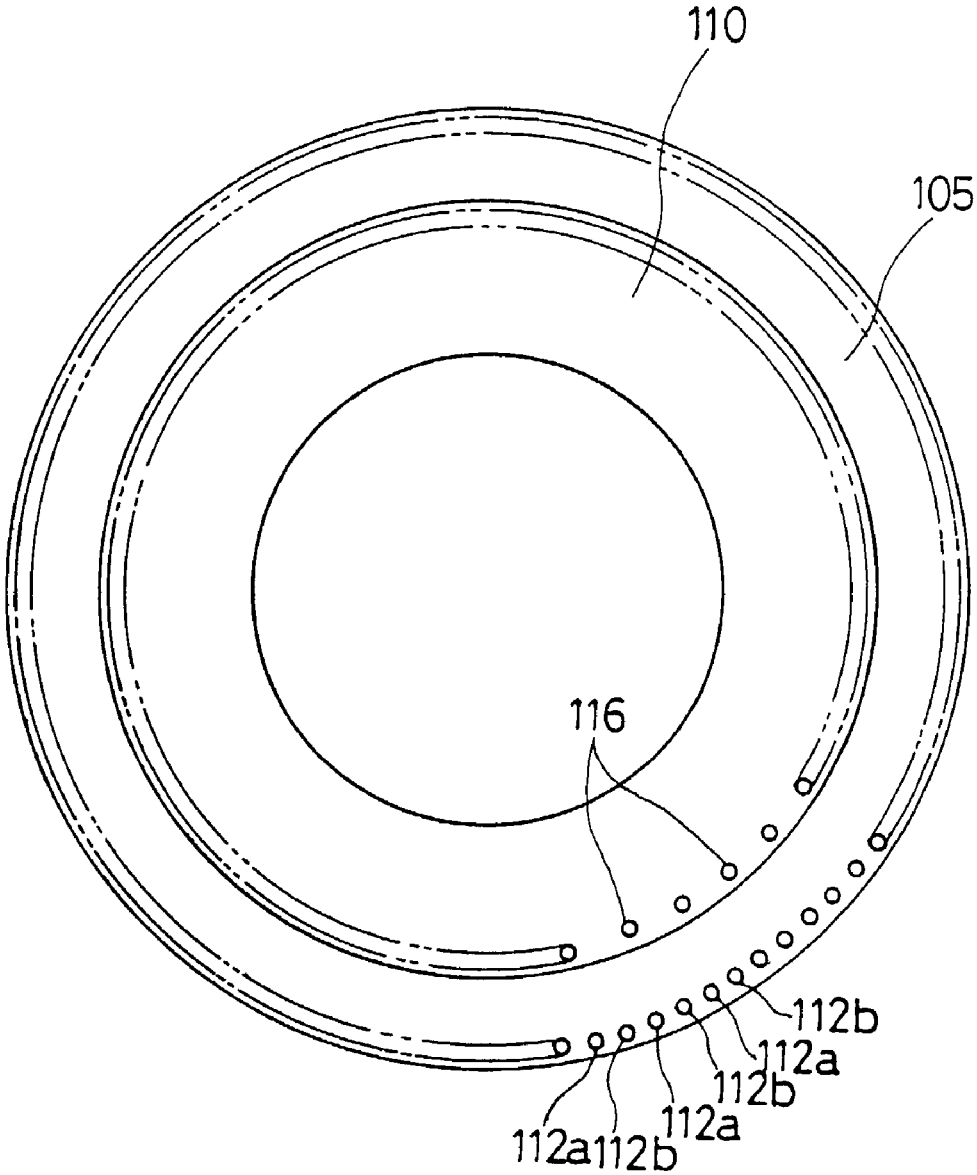
FIG. 15 is a vertical sectional view of the cooling drum shown in FIG. 14.
Figure 16:
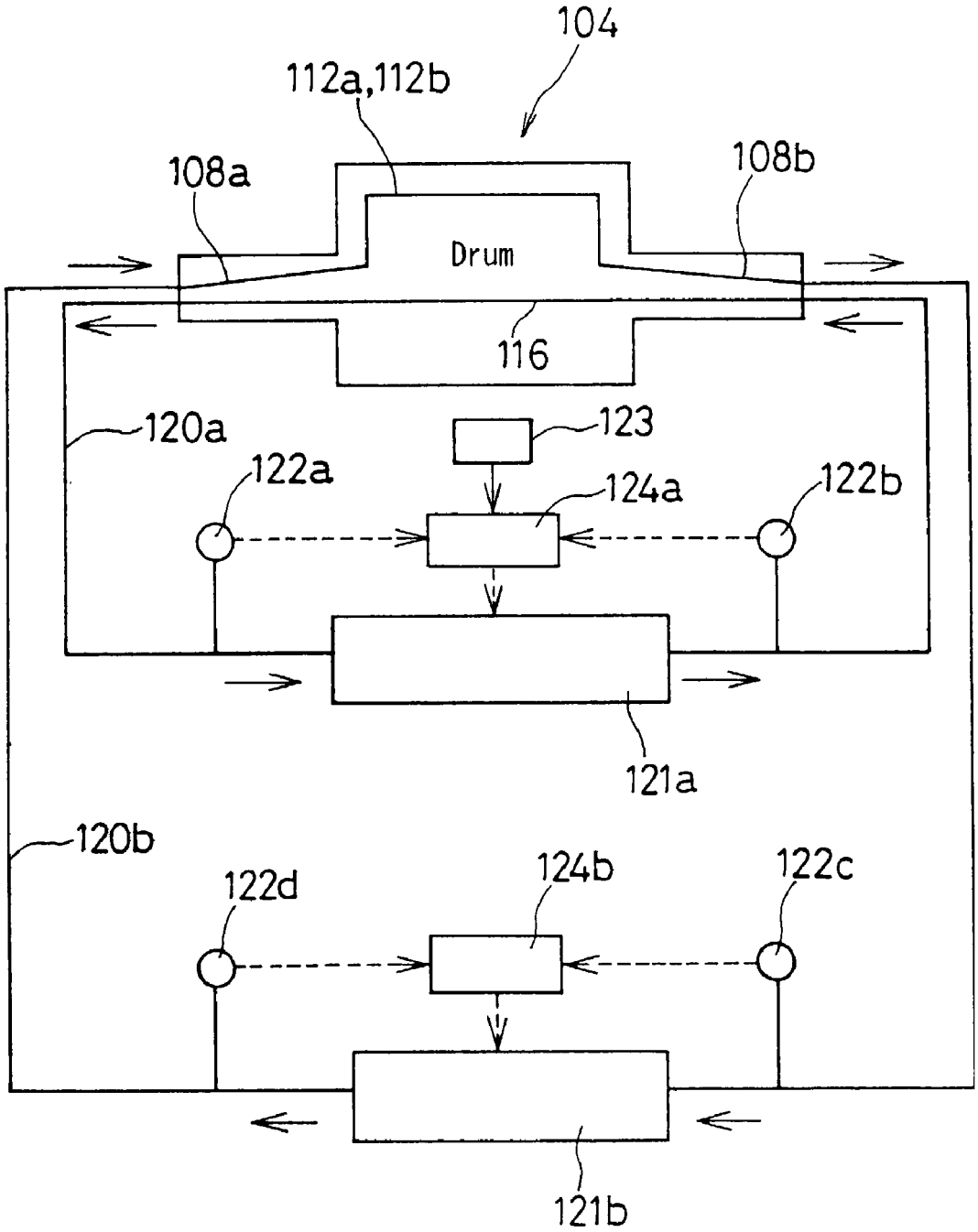
FIG. 16 is a schematic configuration drawing of a crown adjusting device for the cooling drum.
Figure 17:
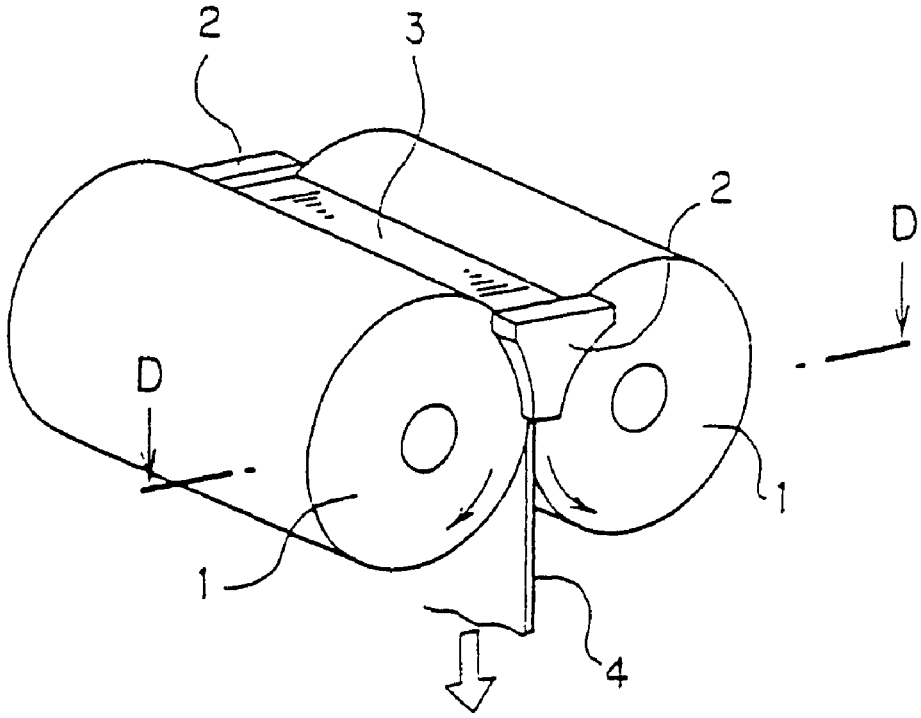
Fig. 17 CONVENTIONAL ART
FIG. 17 is a perspective view of a general drum continuous casting apparatus.

FIG. 14 is a sectional view of an internal structure of a cooling drum showing a tenth embodiment of the present invention. FIG. 15 is a vertical sectional view of the cooling drum shown in FIG. 14. FIG. 16 is a schematic configuration drawing of a crown adjusting device for the cooling drum.

As shown in FIG. 14, a cooling drum 104 has a structure in which a drum sleeve 105 of copper or copper alloy located outwardly is supported from inside by a drum body 106 of steel, such as stainless steel, to increase the rigidity of the cooling drum 104. A circumferential surface 104*a* of the drum is provided with a drum crown (concave crown) which gives a desired cast piece crown during casting. The drum body 106 is dividedly formed from a pair of shaft members 108*a*, 108*b* having hollow shaft portions 107*a*, 107*b* integrally molded therewith, and a core member 110 located between these shaft members, coupled to the shaft members by bolts 109, and mounted on the inner peripheral surface of the drum sleeve 105 by shrink fit. In the drum sleeve 105, many outer layer water channels 112*a*, 112*b* extending in the drum axis direction are provided at predetermined intervals in the circumferential direction of the cooling drum (see FIG. 15). Cooling water passing through the outer layer water channels 112*a*, 112*b* moves along the following two cooling water routes.

In one of the routes, cooling water flowing in from one of the hollow shaft portions, 107*a*, is guided into the outer layer water channel 112*a* provided in the drum sleeve 105 through a water passage 111*a* formed in the core member 110 beside one of the shaft members 108*a*. In the outer layer water channel 112*a*, cooling water takes away heat accumulated in the drum sleeve 105. Then, cooling water passes through a water passage 113*a* formed in the core member 110 beside the other shaft member 108*b*, and a cooling water jacket 114*a*, and is discharged to the outside of the cooling drum through the hollow shaft portion 107*b* of the other shaft member 108*b*.

In the other route, cooling water flowing in from the one hollow shaft portion 107*a* is guided into the outer layer water channel 112*b* provided in the drum sleeve 105 through a water passage 111*b* formed in the core member 110 beside the other shaft member 108*b*. In the outer layer water channel 112*b*, cooling water takes away heat accumulated in the drum sleeve 105. Then, cooling water passes through a water passage 113*b* formed in the core member 110 beside the one shaft member 108*a*, and a cooling water jacket 114*b*, and further arrives at the cooling water jacket 114*a* beside the other shaft member 108*b* past a cooling water piping 115. From there, cooling water passes through the hollow shaft portion 107*b* of the other shaft member 108*b*, and is discharged to the outside of the cooling drum.

Inside the core member 10, many inner layer water channels 16, extending in the drum axis direction along the surface of joining between the core member 10 and the drum sleeve 5, are provided at predetermined intervals in the circumferential direction of the cooling drum 1 (see FIG. 15). Cooling water to pass through the inner layer water channels 16 is flowed through a supply pipe 19*a* from a supply piping 18*a*, and guided into a cooling water jacket 17*b* to cool the inner surface of the core member 10. Then, cooling water is guided to the inner surface water channels 16, where it takes away heat accumulated in the core member 10. Then, cooling water is guided to a cooling water jacket 17*a* to cool the inner surface of the core member 10. Then, it is passed through a return pipe 19*b* and a return piping 18*b*, and discharged to the outside of the cooling drum.

As shown in FIG. 15, the outer layer water channels 112*a*, 112*b* and the inner layer water channels 116 are provided side by side in a circle in the circumferential direction of the cooling drum 104. The outer layer water channels 112*a* and 112*b* are arranged alternately to form flows of cooling water into counter flows, thereby achieving a uniform temperature in the axial direction of the cooling drum.

According to the thus constituted cooling drum, the inner peripheral surface and outer peripheral surface of the core member 110 are directly cooled with cooling water passing through the inner layer water channels 116 and the cooling water jackets 117*a*, 117*b*. Thus, the crown of the cooling drum can be fully controlled. As a result, cast pieces (metal sheets) having an appropriate crown can be produced stably for a long period of time.

FIG. 16 is a view showing the outline of a device for performing crown control of a cast piece with the use of the cooling drum shown in FIGS. 14 and 15. In the drawing, circulation paths 120*a*, 120*b* for cooling water passing through the inner layer water channels 116 and the outer layer water channels 112*a*, 112*b* shown in FIG. 14 are connected to the shaft members 108*a*, 108*b* of the cooling drum 104. Water temperature adjusting devices 121*a*, 121*b* using a cooler and an electric heater are connected to the circulation paths 120*a*, 120*b*.

Water temperature gauges 122*a*, 122*c* are provided on the entrance side of the water temperature adjusting devices 121*a*, 121*b*, while water temperature gauges 122*b*, 122*d* are provided on the exit side of the water temperature adjusting devices 121*a*, 121*b*. Temperature signals on the temperature of cooling water measured with the water temperature gauges 122*a* to 122*d* are taken into water temperature control devices 124*a*, 124*b*. A thickness meter 123 for measuring the profile in the plate width direction of a cast piece is provided below the cooling drum 104, and thickness signals on the thickness of the cast piece measured with the thickness meter 123 are taken into the water temperature control device 124*a*.

Next, the method of controlling the crown of a cast piece complying with claim 13 of the present application, which uses the present apparatus, is described with reference to FIGS. 14 to 16. Before start of casting, the exit side water temperature of the inner layer water channel 116 and the temperature of the core member 110 are nearly the same to achieve an equilibrium condition. When casting is started, molten steel is deprived of heat by the water-cooled drum sleeve 105 to form a shell. The heat that has migrated from the molten steel to the drum sleeve 105 is not transferred 100% to cooling water flowing through the outer layer water channels 112*a*, 112*b* and discharged to the outside of the drum, but remains in a certain proportion in the drum sleeve 105 and further goes to the core member 110. As a result, the temperature of the core member 110 gradually rises with the progress of casting, whereupon the exist-side water temperature of the inner layer water channel 116 rises. If this state continues, the entrance-side and exit-side water temperatures of the inner layer water channel 116 rise. Consequently, the core member 110 increases in temperature and thermally deforms, changing the drum crown, leading to a change in the crown of the cast piece.

To prevent the change in the cast piece crown, there is need to keep the temperature of the core member 110 nearly constant. Since the temperature of the core member 110 is approximated by the exit-side water temperature of the inner layer water channel 116, control is performed to keep the exit-side water temperature constant. That is, the water temperature control device 124*a* shown in FIG. 16 takes in the amounts detected by the water temperature gauges 122*a*, 122*b*, and instructs the water temperature adjusting device 121*a* on the exit-side target water temperature of the inner layer water channel 116 based on the detected values, thereby controlling the exit-side water temperature of the inner layer water channel 116 to become the target water temperature.

On the other hand, the drum sleeve 105 has the role of forming a constant thickness of shell, and thus the fluctuation of its temperature is not preferred. Also, the drum sleeve 105 is made of a highly heat conductive material, and is close to the heat receiving surface. Thus, its thermal expansion is completed in a short time after start of casting, and changes thereafter are small. Hence, cooling water supplied to the outer layer water channels 112*a*, 112*b* is preferably not temperature-controlled, but is controlled in such a manner as to maintain a constant temperature during casting.

That is, control of cooling water fed to the outer layer water channels 112*a*, 112*b* is performed by comparing the water temperatures, measured with the water temperature gauges 122*c*, 122*d*, with the water temperature, for obtaining a solidified shell of a predetermined thickness, by the water temperature control device 124*b*, and controlling the water temperature adjusting device 121*b* based on signals corresponding to the differences found by comparison and the water temperature difference between the water temperature gauges 122*c* and 122*d*, thereby keeping the temperature of the drum sleeve 105 constant during casting. According to the control method recited in claim 13, the response of the drum crown to control is excellent, because the water temperature of the inner layer water channel, greatly affecting the drum crown, is taken into the control system. However, the cast piece crown, the object of control, is not taken into the control system, and thus the control accuracy is one step short of satisfaction.

The control method for the cast piece crown complying with claim 14 of the present invention is as follows: The water temperature control device 124*a* shown in FIG. 16 computes the cast piece crown from signals on the profile in the plate width direction of the cast piece measured with the thickness meter 123, and compares the computed crown with the preset target crown. If the computed crown is smaller than the target crown, the water temperature control device 124*a* outputs a signal for lowering the temperature of cooling water. If the computed crown is larger than the target crown, the water temperature control device 124*a* outputs a signal for raising the temperature of cooling water. The water temperature adjusting device 121*a* is controlled in accordance with such signals.

Subsequently, the water temperature control device 124*a* accepts signals from the thickness meter 123, makes comparisons with the target crown, and when the computed crown reaches the target crown, stops control of the water temperature adjusting device 121*a*. On the other hand, control of cooling water fed to the outer layer water channels 112*a*, 112*b* is the same as in claim 13. According to the control method recited in claim 14, the cast piece crown, the object of control, is taken into the control system, so that the control accuracy is improved over the method of claim 13. However, the water temperature of the inner layer water channel, which greatly affects the drum crown, is not taken into the control system. Thus, a time delay is liable to occur between the change in the water temperature and the change in the cast piece crown, making the response to control one step short of satisfaction.

In the foregoing descriptions, the cooling drum comprising the drum sleeve of a steel alloy fitted around the core member of stainless steel is taken as an example of the cooling drum 104. However, the cooling drum 104 may be one having the outer layer water channels along the circumferential surface of the drum, and the inner layer water channels inwardly of the outer layer water channels, and the structure of and the raw material for the drum are not restricted to those of FIG. 14.

EXPERIMENTAL EXAMPLES

The cast pieces produced by Examples of the present invention and Comparative Examples were examined for the proportion in which the crown resides in the range of the target value ±5 μm.

In the Comparative Examples, the cooling drums shown in FIGS. 20 and 21 were used, and the temperature of cooling water supplied to the cooling water channels provided in the drum sleeve 10 was controlled in accordance with the crown of the cast pieces delivered from the cooling drums.

Example 1 of the present invention is an example following claim 13, in which the cooling drum 104 shown in FIG. 14 was used, and the temperature of cooling water supplied to the inner layer water channels 116 was controlled in accordance with the temperature of cooling water discharged from the inner layer water channels.

Example 2 of the present invention is an example following claim 14, in which the cooling drum 104 shown in FIG. 14 was used, and the temperature of cooling water supplied to the inner layer water channels 116 was controlled in accordance with the profile in the plate width direction of the thin strip cast piece delivered from the cooling drums.

Example 3 of the present invention is an example following claim 15, in which the cooling drum 104 shown in FIG. 14 was used, and the temperature of cooling water supplied to the inner layer water channels 116 was controlled in accordance with the temperature of cooling water discharged from the inner layer water channels, whereafter the temperature of cooling water supplied to the inner layer water channels 116 was controlled in accordance with the profile in the plate width direction of the thin strip cast piece delivered from the cooling drums.

As a result, the proportion of the cast piece crown being in the range of the target value ±5 μm was 50% in the Comparative Examples, 87% in Example 1 of the present invention, 95% in Example 2 of the present invention, and 100% in Example 3 of the present invention.

Needless to say, the present invention is not limited to the aforementioned Embodiments, and various changes and modifications may be made without departing from the gist of the present invention.

INDUSTRIAL APPLICABILITY

As described above, the twin-drum continuous casting apparatus and method according to the present invention have means for preventing various adverse influences due to differences in thermal expansion of constituent members during casting using cooling drums, thereby increasing the reliability of the apparatus, and improving the quality of casting.

The invention claimed is:

1. A twin-drum continuous casting apparatus for casting a metal sheet by supplying molten metal to a pouring basin formed by a pair of cooling drums rotating in opposite directions, and side gates, to cool the molten metal by contact with surfaces of the cooling drums, thereby forming a solidified shell, characterized in that the cooling drum is formed from a drum body having shaft portions at opposite end portions, and a drum sleeve fitted on an outer peripheral portion of the drum body, and the drum is formed from, and divided into, a pair of shaft members having the shaft portions provided integrally therewith and being joined to end portions of the drum sleeve, and a core member located between the shaft members and shrink fitted to an inner peripheral surface of the drum sleeve without contacting the shaft members.

2. The twin-drum continuous casting apparatus of claim 1, characterized in that in shrink fit between the drum sleeve and the core member supporting the drum sleeve from inside, a tightening margin at an intermediate portion in a drum axis direction is greater than a tightening margin at the end portion.

3. The twin-drum continuous casting apparatus of claim 1, characterized in that a wall thickness of the intermediate portion in the drum axis direction of the core member supporting the drum sleeve from inside is larger than a wall thickness of the end portion.

4. The twin-drum continuous casting apparatus of claim 1, characterized in that the end portions of the drum sleeve and the shaft members are fastened together by bolts.

5. The twin-drum continuous casting apparatus of claim 1, characterized in that many hot water channels, each extending in a drum axis direction along joining surfaces of the drum body and the drum sleeve, are formed at least within the drum body at predetermined intervals in a circumferential direction.

6. The twin-drum continuous casting apparatus of claim 5, characterized in that supply and discharge of hot water into and from the hot water channels are performed via hot water jackets formed along an inner surface of the drum body in order to heat the inner surface of the drum body.

7. The twin-drum continuous casting apparatus of claim 5, characterized in that cooling water, which has flowed through a cooling water hole of the drum sleeve and turned into hot water upon heat exchange, is supplied to the hot water channels.

8. The twin-drum continuous casting apparatus of claim 5, characterized in that hot water is supplied to the hot water channels before start of casting to preheat the drum.

9. The twin-drum continuous casting apparatus of claim 1, characterized in that the drum body is made of SUS, the drum sleeve is made of a Cu alloy, and the SUS drum body is composed of a plurality of ring-shaped core members arranged dividedly at intervals in an axial direction.

10. The twin-drum continuous casting apparatus of claim 9, characterized in that the Cu alloy drum sleeve is composed of a 60 to 100 mm thick sheet.

11. The twin-drum continuous casting apparatus of claim 9, characterized in that of the plural core members provided dividedly, the core members located at opposite end portions of the drum body have axial end surfaces to which drum shafts are fixed, and have circumferential surfaces, which are fitted to the Cu alloy drum sleeve, formed so as to be wider than circumferential surfaces of the core members at an intermediate portion of the drum body, and the core members arranged in the intermediate portion each have a convex small-width portion on a circumferential surface thereof, the convex small-width portion being fitted to the Cu alloy drum sleeve.

12. The twin-drum continuous casting apparatus of claim 1, characterized in that outer layer water channels are provided in the drum sleeve, inner layer water channels are provided in the drum body, cooling water is supplied to the outer layer water channels and the inner layer water channels, a measuring device is provided for measuring a temperature of cooling water discharged from the inner layer water channels, and a control device is provided for controlling a temperature of cooling water supplied to the inner layer water channels in accordance with the cooling water temperature from the measuring device.

13. The twin-drum continuous casting apparatus of claim 1, characterized in that outer layer water channels are provided in the drum sleeve, inner layer water channels are provided in the drum body, cooling water is supplied to the outer layer water channels and the inner layer water channels, a measuring device is provided for measuring a profile in a plate width direction of the metal sheet delivered from the cooling drums, and a control device is provided for controlling a temperature of cooling water supplied to the inner layer water channels in accordance with the profile from the measuring device.

14. The twin-drum continuous casting apparatus of claim 1, characterized in that outer layer water channels are provided in the drum sleeve, inner layer water channels are provided in the drum body, cooling water is supplied to the outer layer water channels and the inner layer water channels, measuring devices are provided for measuring a temperature of cooling water discharged from the inner layer water channels, and a profile in a plate width direction of the metal sheet delivered from the cooling drums, and a control device is provided for controlling a temperature of cooling water supplied to the inner layer water channels in accordance with the cooling water temperature and the profile from the measuring devices.

15. In a twin-drum continuous casting apparatus for casting a metal sheet by supplying molten metal to a pouring basin formed by a pair of cooling drums rotating in opposite directions, and side gates, to cool the molten metal by contact with surfaces of the cooling drums, thereby forming a solidified shell, a twin-drum continuous casting method characterized by forming the cooling drum from a drum body having shaft portions at opposite end portions, and a drum sleeve fitted on an outer peripheral portion of the drum body, and implementing means for preventing various adverse influences due to differences in thermal expansion of constituent members of the drum body during casting, said means being such that many hot water channels, each extending in a drum axis direction along joining surfaces of the drum body and the drum sleeve, are formed at least within the drum body at predetermined intervals in a circumferential direction, and supply and discharge of hot water into and from the hot water channels are performed via hot water jackets formed along an inner surface of the drum body in order to heat the inner surface of the drum body, wherein hot water is supplied to the hot water channels before start of casting to preheat the drum.

16. The twin-drum continuous casting method of claim 15, characterized in that cooling water, which has flowed through a cooling water hole of the drum sleeve and turned into hot water upon heat exchange, is supplied to the hot water channels.

17. A twin-drum continuous casting method comprising:

providing outer layer water channels in a portion of each of cooling drums along a circumferential surface of the cooling drum;

providing inner layer water channels inwardly of the outer layer water channels; and casting a metal sheet while supplying cooling water to the outer layer water channels and the inner layer water channels, and characterized by:

measuring a temperature of cooling water discharged from the inner layer water channels; and controlling a temperature of cooling water supplied to the inner layer water channels in accordance with the measured temperature, thereby controlling crown of the metal sheet.

18. A twin-drum continuous casting method comprising:

providing outer layer water channels in a portion of each of cooling drums along a circumferential surface of the cooling drum;

providing inner layer water channels inwardly of the outer layer water channels; and casting a metal sheet while supplying cooling water to the outer layer water channels and the inner layer water channels, and characterized by:

measuring a profile in a plate width direction of the metal sheet delivered from the cooling drums; and controlling a temperature of cooling water supplied to the inner layer water channels in accordance with the measured profile, thereby controlling crown of the metal sheet.

19. A twin-drum continuous casting method comprising:

providing outer layer water channels in a portion of each of cooling drums along a circumferential surface of the cooling drum;

providing inner layer water channels inwardly of the outer layer water channels; and casting a metal sheet while supplying cooling water to the outer layer water channels and the inner layer water channels, and characterized by:

measuring a temperature of cooling water discharged from the inner layer water channels, and a profile in a plate width direction of the metal sheet delivered from the cooling drums; and controlling a temperature of cooling water supplied to the inner layer water channels in accordance with the temperature of cooling water and the profile, thereby controlling crown of the metal sheet.

* * * * *